US012709947B2

(12) United States Patent
Centala

(10) Patent No.: US 12,709,947 B2
(45) Date of Patent: Aug. 18, 2026

(54) CUTTER ELEMENTS WITH CONCAVE RECESSES AND FIXED CUTTER DRILL BIT INCLUDING SAME

(71) Applicant: National Oilwell Varco, L.P., Houston, TX (US)

(72) Inventor: Prabhakaran Centala, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 19/205,586

(22) Filed: May 12, 2025

(65) Prior Publication Data

US 2025/0354441 A1 Nov. 20, 2025

Related U.S. Application Data

(60) Provisional application No. 63/647,751, filed on May 15, 2024.

(51) Int. Cl.
*E21B 10/567* (2006.01)

(52) U.S. Cl.
CPC ..... *E21B 10/5673* (2013.01)

(58) Field of Classification Search
CPC ..... E21B 10/5673; E21B 10/5676
See application file for complete search history.

(56) References Cited

U.S. PATENT DOCUMENTS 4,997,049 A * 3/1991 Tank ..... B23B 27/141 407/119
5,333,699 A * 8/1994 Thigpen ..... E21B 10/573 175/431
7,363,992 B2 * 4/2008 Stowe ..... E21B 10/5673 175/426
10,022,840 B1 * 7/2018 Miess ..... E21B 10/567
(Continued)

FOREIGN PATENT DOCUMENTS

WO 2023/200584 A1 10/2023

OTHER PUBLICATIONS

PCT/US2025/028924 International Search Report and Written Opinion dated Sep. 1, 2025 (14 p.).

*Primary Examiner* — Blake Michener
(74) *Attorney, Agent, or Firm* — CONLEY ROSE, P.C.

(57) ABSTRACT

A cutter element for a fixed cutter drill bit configured to drill a borehole in a subterranean formation includes a base portion having a central axis, a first end, a second end, and a radially outer surface extending axially from the first end to the second end. In addition, the cutter element includes a cutting layer fixably mounted to the first end of the base portion. The cutting layer includes a cutting face distal the base portion and a radially outer surface extending axially from the cutting face to the radially outer surface of the base portion. The cutting face includes a planar surface disposed in a plane oriented perpendicular to the central axis and a concave recess extending axially into the planar surface. The planar surface extends circumferentially about the concave
(Continued)

recess. The planar surface has an average surface roughness Ra and the concave surface has an average surface roughness Ra. The average surface roughness Ra of the planar surface is less than the average surface roughness Ra of the concave surface.

25 Claims, 15 Drawing Sheets

(56) References Cited

U.S. PATENT DOCUMENTS

| | | | | |
|---|---|---|---|---|
| 10,502,000 | B2 * | 12/2019 | Shotwell | E21B 10/627 |
| 10,807,913 | B1 * | 10/2020 | Hawks | E21B 10/567 |
| 2010/0084198 | A1 * | 4/2010 | Durairajan | E21B 10/55<br>175/425 |
| 2010/0288564 | A1 * | 11/2010 | Dovalina, Jr. | E21B 10/5676<br>175/428 |
| 2012/0103700 | A1 * | 5/2012 | Lin | E21B 10/5676<br>175/428 |
| 2013/0068537 | A1 | 3/2013 | DiGiovanni | |
| 2013/0306377 | A1 | 11/2013 | DiGiovanni et al. | |
| 2014/0116788 | A1 | 5/2014 | Patel et al. | |
| 2022/0316280 | A1 | 10/2022 | Doster | |
| 2025/0223872 | A1 * | 7/2025 | Sheikhrezaei | E21B 10/5676 |

* cited by examiner

CUTTER ELEMENTS WITH CONCAVE RECESSES AND FIXED CUTTER DRILL BIT INCLUDING SAME

CROSS-REFERENCE TO RELATED APPLICATIONS

This application claims benefit of U.S. provisional patent application Ser. No. 63/647,751 filed May 15, 2024, and entitled "Cutter Elements with Concave Recesses and Fixed Cutter Drill Bits Including Same," which is hereby incorporated herein by reference in its entirety for all purposes.

STATEMENT REGARDING FEDERALLY SPONSORED RESEARCH OR DEVELOPMENT

Not applicable.

FIELD

The present disclosure relates generally to earth-boring bits used to drill a borehole for the ultimate recovery of oil, gas or minerals. More particularly, the present disclosure relates to fixed cutter drill bits with improved cutter elements.

BACKGROUND

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created has a diameter generally equal to the diameter or "gage" of the drill bit.

Fixed cutter bits, also known as rotary drag bits, are one type of drill bit commonly used to drill boreholes. Fixed cutter bit designs include a plurality of blades angularly spaced about a bit face. The blades generally project radially outward along the bit face and form flow channels therebetween. Cutter elements are typically grouped and mounted on the blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PCD") material. In the typical fixed cutter bit, each cutter element includes an elongate and generally cylindrical support member that is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate), as well as mixtures or combinations of these materials. The cutting layer is mounted to one end of the corresponding support member, which is typically formed of tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the passageways between the several blades. The drilling fluid exiting the face of the bit through nozzles or ports performs several functions. In particular, the fluid removes formation cuttings (for example, rock chips) from the cutting structure of the drill bit. Otherwise, accumulation of formation cuttings on the cutting structure may reduce or prevent the penetration of the drill bit into the formation. In addition, the fluid removes formation cuttings from the bottom of the hole. Failure to remove formation materials from the bottom of the hole may result in subsequent passes by cutting structure to essentially re-cut the same materials, thereby reducing the effective cutting rate and potentially increasing wear on the cutting surfaces of the cutter elements. The drilling fluid flushes the cuttings removed from the bit face and from the bottom of the hole radially outward and then up the annulus between the drill string and the borehole sidewall to the surface. Still further, the drilling fluid removes heat, caused by contact with the formation, from the cutter elements to prolong cutter element life.

BRIEF SUMMARY

Embodiments of cutter elements for fixed cutter drill bits configured to drill boreholes in subterranean formations are disclosed herein. In one embodiment, a cutter element for a fixed cutter drill bit comprises a base portion having a central axis, a first end, a second end, and a radially outer surface extending axially from the first end to the second end. In addition, the cutter element comprises a cutting layer fixably mounted to the first end of the base portion. The cutting layer includes a cutting face distal the base portion and a radially outer surface extending axially from the cutting face to the radially outer surface of the base portion. The cutting face includes a planar surface disposed in a plane oriented perpendicular to the central axis and a concave recess extending axially into the planar surface. The planar surface extends circumferentially about the concave recess. The planar surface has an average surface roughness Ra and the concave surface has an average surface roughness Ra. The average surface roughness Ra of the planar surface is less than the average surface roughness Ra of the concave surface.

In another embodiment, a cutter element for a fixed cutter drill bit comprises a base portion having a central axis, a first end, a second end, and a radially outer surface extending axially from the first end to the second end. In addition, the cutter element comprises a cutting layer fixably mounted to the first end of the base portion. The cutting layer includes a cutting face distal the base portion and a radially outer surface extending axially from the cutting face to the radially outer surface of the base portion. The cutting face includes a planar surface disposed in a plane oriented perpendicular to the central axis and a concave recess extending axially into the planar surface. The planar surface extends circumferentially about the concave recess. The concave recess is defined by a continuously contoured concave surface that is free of planar surfaces. The concave recess has a geometric center in a top view of the cutter element that is intersected by the central axis. The concave recess is circular in the top view of the cutter element. The concave surface is disposed at a uniform radius of curvature R.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
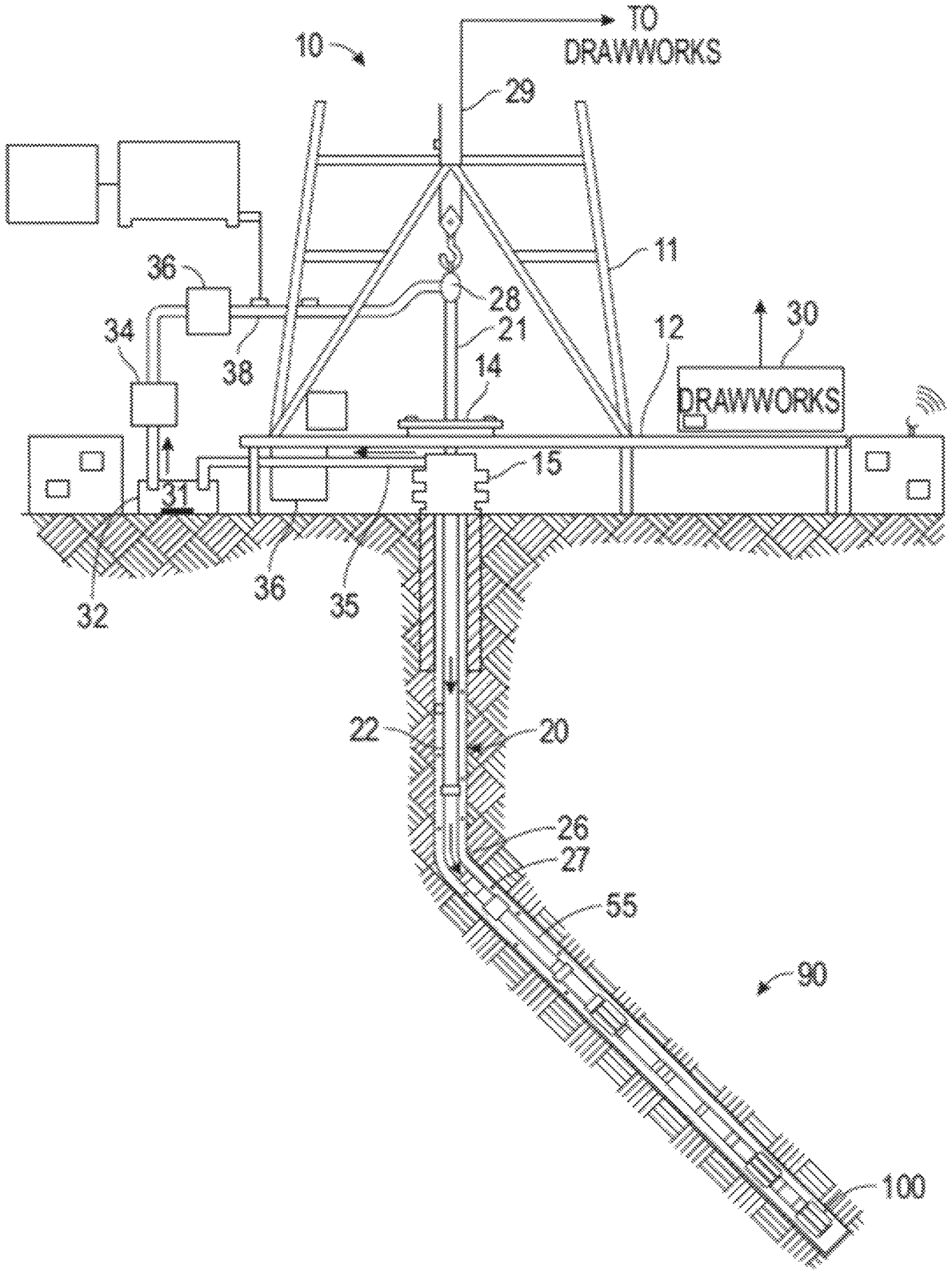
FIG. 1 is a schematic view of a drilling system including an embodiment of a drill bit in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

The cost of drilling a borehole for recovery of hydrocarbons may be very high and is proportional to the length of time it takes to drill to the desired depth and location. The time required to drill the well, in turn, is greatly affected by the rate of penetration ("ROP") of the drill bit into the formation and the operational life of the drill bit. For instance, each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. This process, known as a "trip" of the drill string, requires considerable time, effort and expense. Accordingly, it is desirable to employ drill bits which will drill faster and longer.

The length of time that a drill bit may be employed before it must be changed depends upon a variety of factors. These factors include the bit's ROP, as well as its durability or ability to maintain a high or acceptable ROP. One factor that significantly affects ROP and durability for a drill bit is the cutting efficiency of the cutter elements of the drill bit during drilling. The cutting efficiency of a cutter element refers to a measure or ratio of the volume of rock removed for a given driving force applied to the cutter element. Accordingly, embodiments of drill bits described herein and the associated cutter elements offer the potential to improve cutting efficiency during drilling.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (for example, rotary table 14) may be augmented or replaced by a top drive suspended in the derrick (for example, derrick 11) and connected to the drillstring (for example, drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 or a top drive, rotated by downhole mud motor 55 disposed along drillstring 20 proximal bit 100, or combinations thereof (for example, rotated by both rotary table 14 via drillstring 20 and mud motor 55, rotated by a top drive and the mud motor 55, etc.). For example, rotation via downhole motor 55 may be employed to supplement the rotational power of rotary table 14, if required, or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations, a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
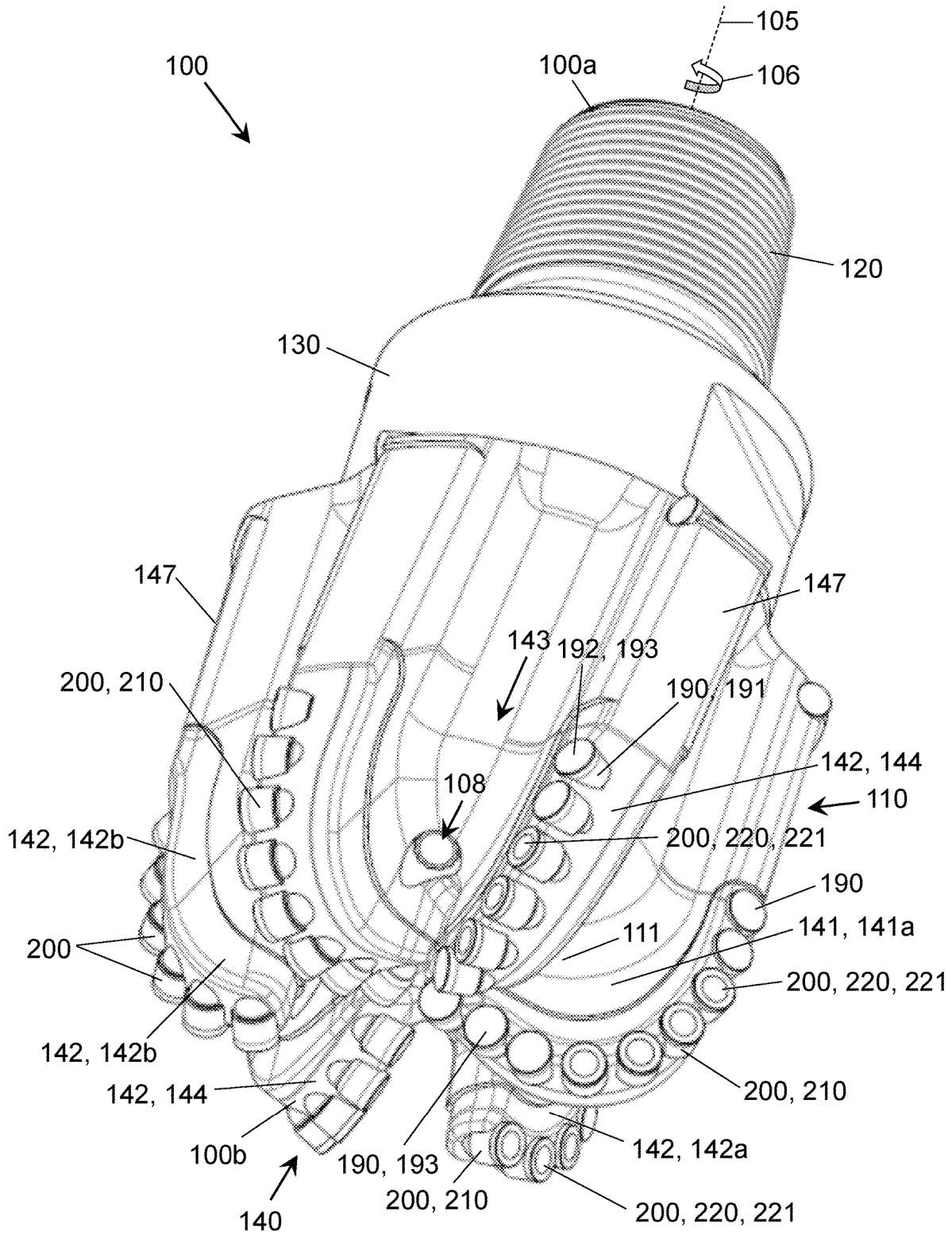
FIG. 2 is a perspective view of the drill bit of FIG. 1.
Figure 3:
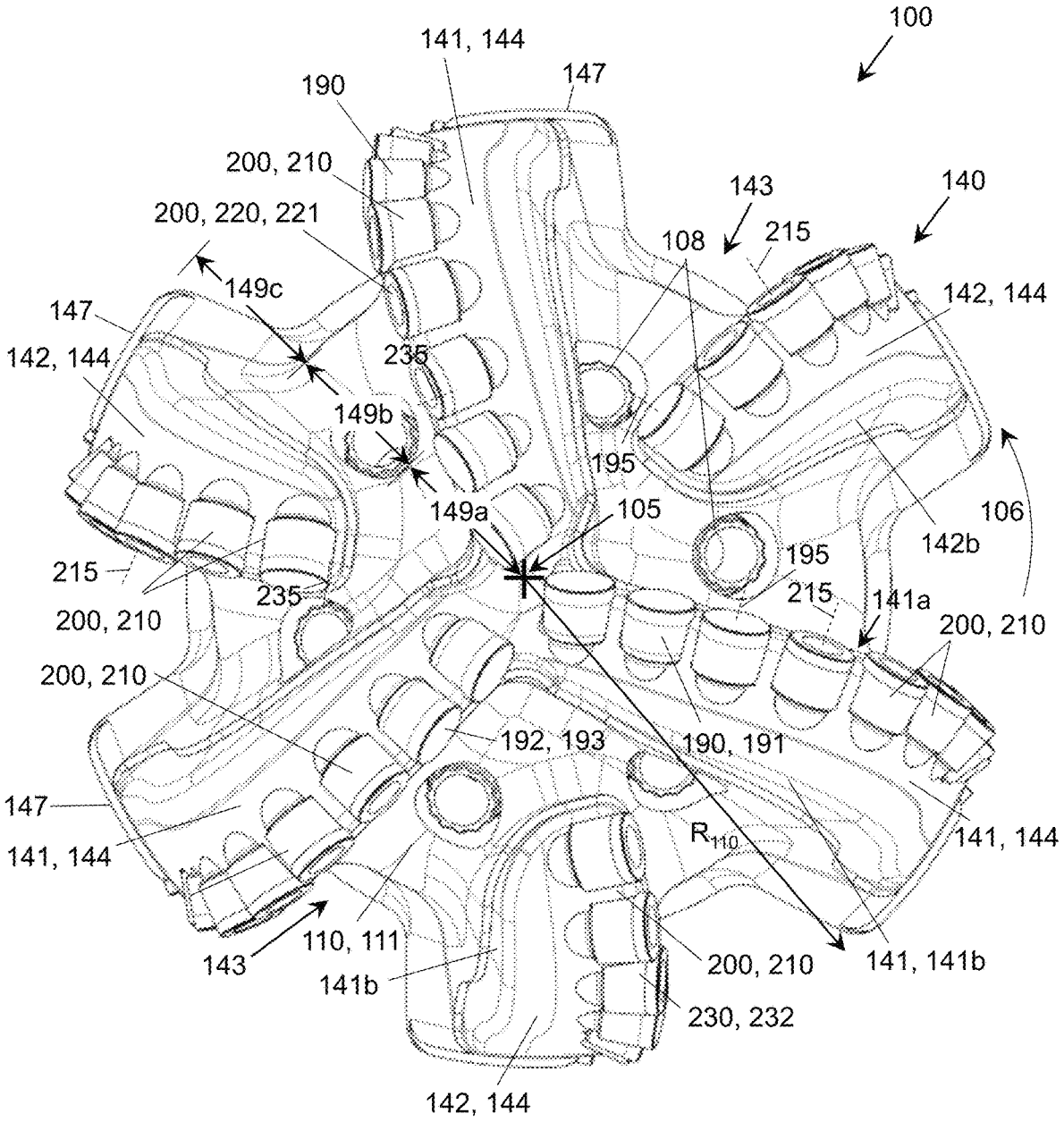
FIG. 3 is an end view of the drill bit of FIG. 2.

Referring now to FIGS. 2 and 3, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to a drill string (not shown), which is employed to rotate the bit 100 in order to drill the borehole. Bit body 110, shank 130, and pin 120 are coaxially aligned with axis 105, and thus, each has a central axis coincident with axis 105.

Figure 4:
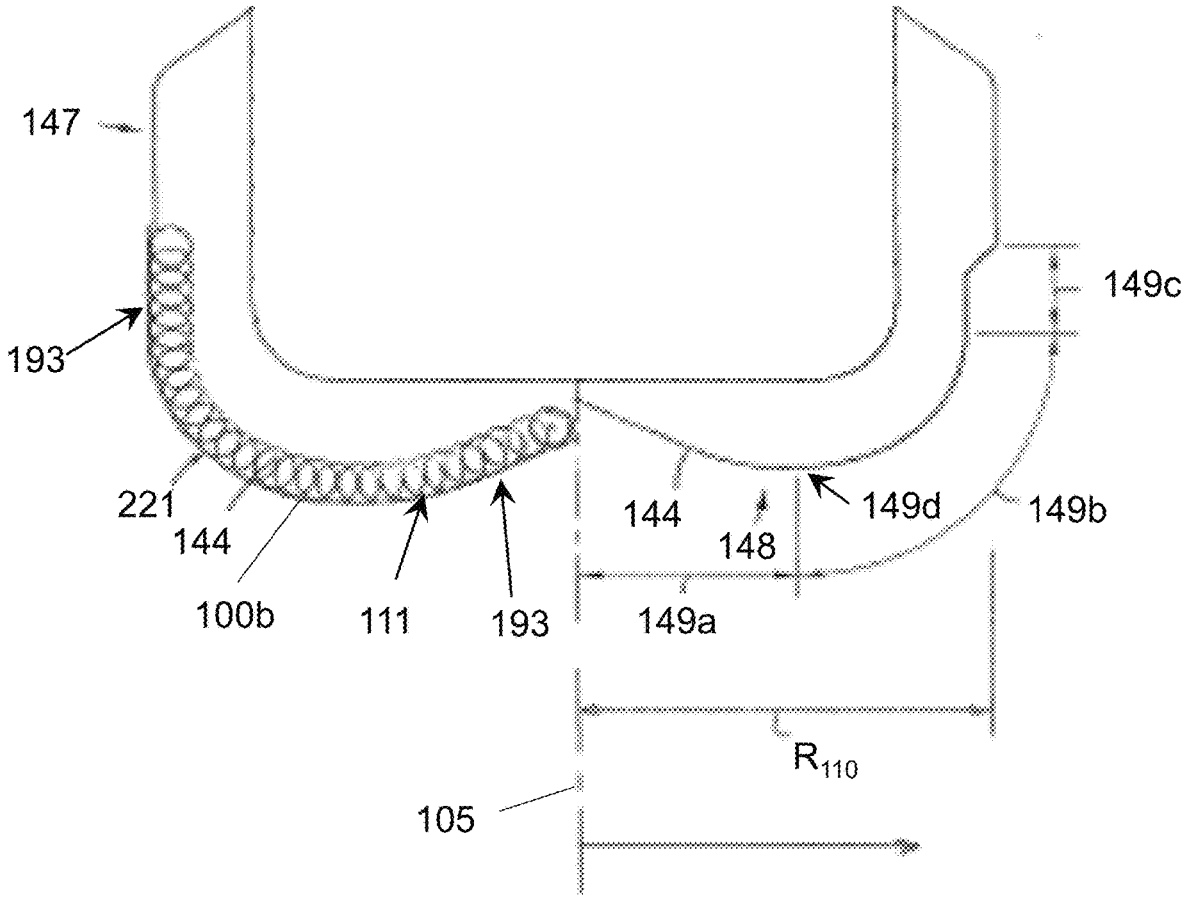
FIG. 4 is a partial cross-sectional schematic view of the bit shown in FIG. 2 with the blades and the cutting faces of the cutter elements rotated into a single composite profile.

The portion of bit body 110 that faces the formation at downhole end 100*b* includes a bit face 111 provided with a cutting structure 140. Cutting structure 140 includes a plurality of blades that extend from bit face 111. As best shown in FIG. 4, in this embodiment, cutting structure 140 includes three angularly spaced-apart primary blades 141 and three angularly spaced apart secondary blades 142. Further, in this embodiment, the plurality of blades (for example, primary blades 141, and secondary blades 142) are uniformly angularly spaced on bit face 111 about bit axis 105. In particular, the three primary blades 141 are uniformly angularly spaced about 120° apart, the three secondary blades 142 are uniformly angularly spaced about 120° apart, and each primary blade 141 is angularly spaced about 60° from each circumferentially adjacent secondary blade 142. In other embodiments, one or more of the blades may be spaced non-uniformly about bit face 111. Still further, in this embodiment, the primary blades 141 and secondary blades 142 are circumferentially arranged in an alternating fashion. In other words, one secondary blade 142 is disposed between each pair of circumferentially-adjacent primary blades 141. Although bit 100 is shown as having three primary blades 141 and three secondary blades 142, in general, bit 100 may comprise any suitable number of primary and secondary blades. As one example only, bit 100 may comprise two primary blades and four secondary blades.

Referring still to FIGS. 2 and 3, in this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the direction of rotation 106 of bit 100.

Each blade 141, 142 includes a cutter-supporting surface 144 that generally faces the formation during drilling and extends circumferentially from the leading side 141*a* to the trailing side 142 of the corresponding blade 141, 142. In this embodiment, a plurality of cutter elements 190, 200 are fixably attached to each blade 141, 142 and extend from cutter-supporting surface 144 of each blade 141, 142. Cutter elements 190, 200 are generally arranged adjacent one another in a radially extending row proximal the leading side 141*a* of each primary blade 141 and each secondary blade 142. In this embodiment, cutter elements 190 are generally arranged adjacent the plurality of cutter elements 200 on each blade 141, 142, and in the same radially extending row as cutter elements 200.

Each cutter element 190 includes an elongated and generally cylindrical support base or substrate 191 and a cylindrical disk or tablet-shaped, hard cutting layer 192 of polycrystalline diamond or other superabrasive material bonded to the exposed end of substrate 191. Substrate 191 has a central axis 195, and is received and secured in a pocket formed in cutter supporting surface 144 of the corresponding blade 141, 142 to which it is fixably mounted. The cylindrical disc, hard cutting layer 192 defines a cutting surface or cutting face 193 of the corresponding cutter element 190. In this embodiment, each cutting face 193 is completely planar. Each cutter element 190 is mounted such that the corresponding central axis 195 is substantially parallel to or at an acute angle relative to the cutting direction of the bit (for example, cutting direction 106 of bit 100). Such orientation results in the corresponding cutting face 193 being generally forward-facing relative to the cutting direction of the bit (for example, cutting direction 106 of bit 100).

As will be described in more detail below, each cutter element 200 also includes an elongated and generally cylindrical support base or substrate 210 and a cylindrical disk or tablet-shaped, hard cutting layer 220 of polycrystalline diamond or other superabrasive material bonded to the exposed end of substrate 210. Substrate 210 has a central axis 215, and is received and secured in a pocket formed in cutter supporting surface 144 of the corresponding blade 141, 142 to which it is fixably mounted. The cylindrical disc, hard cutting layer 220 defines a cutting surface or cutting face 221 of the corresponding cutter element 200. However, unlike conventional cutter elements 190, which have planar cutting faces, cutting faces 221 of cutter elements 200 are not completely planar. In particular, each cutting face 221 includes a generally spherical recess or dimple, as will be described in more detail below. As used herein, the phrase "non-planar" may be used to refer to a cutting face that includes one or more curved surfaces (for example, concave surface(s), convex surface(s), or combinations thereof), a plurality of distinct planar surfaces that intersect at distinct edges along the cutting face, or both.

Each cutter element 200 is mounted such that the corresponding central axis 215 is substantially parallel to or at an acute angle relative to the cutting direction of the bit (for example, cutting direction 106 of bit 100). Such orientation results in the corresponding cutting face 221 being generally forward-facing relative to the cutting direction of the bit (for example, cutting direction 106 of bit 100).

Referring still to FIGS. 2 and 3, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when Cutter elements 200 wear slightly under gage. Gage pads 147 also help stabilize bit 100 against vibration.

Referring now to FIG. 4, an exemplary profile of blades 141, 142 is shown as it would appear with blades 141, 142 and cutting faces 193, 221 rotated into a single rotated profile. In rotated profile view, blades 141, 142 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* is the radially innermost region of bit body 110 and composite blade profile 148 that extends from bit axis 105 to shoulder region 149*b*. In this embodiment, cone region 149*a* is generally concave. Adjacent cone region 149*a* is generally convex shoulder region 149*b*. The transition between cone region 149*a* and shoulder region 149*b*, referred herein to as the nose 149*d*, occurs at the axially outermost portion of composite blade profile 148 (relative to bit axis 105) where a tangent line to the blade profile 148 has a slope of zero. Moving radially outward, adjacent shoulder region 149*b* is the gage region 149*c*, which extends substantially parallel to bit axis 105 at the outer radial periphery of composite blade profile 148. As shown in composite blade profile 148, gage pads 147 define the gage region 149*c* and the outer radius $R_{110}$ of bit body 110. Outer radius $R_{110}$ extends to and therefore defines the full gage diameter of bit 100.

Referring briefly to FIG. 3, moving radially outward from bit axis 105, bit 100 and bit face 111 include cone region 149*a*, shoulder region 149*b*, and gage region 149*c* as previously described. Primary blades 141 extend radially along bit face 111 from within cone region 149*a* proximal bit axis 105 toward gage region 149*c* and outer radius $R_{110}$. Secondary blades 142 extend radially along bit face 111 from proximal nose 149*d* toward gage region 149*c* and outer radius $R_{110}$. Thus, in this embodiment, each primary blade 141 and each secondary blade 142 extends substantially to gage region 149*c* and outer radius $R_{110}$. In some embodiments (e.g., such as in the embodiment of FIG. 4), secondary blades 142 do not extend into cone region 149*a*, and thus, secondary blades 142 occupy no space on bit face 111 within cone region 149*a*. Although a specific embodiment of bit body 110 has been shown in described, one skilled in the art will appreciate that numerous variations in the size, orientation, and locations of the blades (for example, primary blades 141, secondary blades, 142, etc.), and cutter elements (for example, cutter elements 200) are possible. As shown in FIGS. 3 and 4, cutter elements 190 are generally positioned along blades 141, 142 in cone region 149*a* and gauge region 149*c*, whereas cutter elements 200 are positioned along blades 141, 142 along shoulder region 149*b*.

Bit 100 includes an internal plenum (not shown) extending axially from uphole end 100*a* through pin 120 and shank 130 into bit body 110. The plenum allows drilling fluid to flow from the drill string into bit 100. Body 110 is also provided with a plurality of flow passages (not shown) extending from the plenum to downhole end 100*b*. As best shown in FIGS. 2 and 3, a nozzle 108 is seated in the lower end of each flow passage. Together, the plenum (not shown), passages (not shown), and nozzles 108 serve to distribute drilling fluid around cutting structure 140 to flush away formation cuttings and to remove heat from cutting structure 140, and more particularly cutter elements 190, 200 during drilling.

Referring now to FIGS. 5-8, as previously described, cutter element 200 includes base or substrate 210 and cutting disc or layer 220 bonded to the substrate 210. Cutting layer 220 and substrate 210 meet at a reference plane of intersection 219 that defines the location at which substrate 210 and cutting layer 220 are fixably attached. In this embodiment, substrate 210 is made of tungsten carbide and cutting layer 220 is made of an ultrahard material such as polycrystalline diamond (PCD) or other superabrasive material. Part or all of the diamond in cutting layer 220 may be leached, finished, polished, or otherwise treated to enhance durability, efficiency or effectiveness. While cutting layer 220 is shown as a single layer of material mounted to substrate 210, in general, the cutting layer (for example, layer 220) may be formed of one or more layers of one or more materials. In addition, although substrate 210 is shown as a single, homogenous material, in general, the substrate (for example, substrate 210) may be formed of one or more layers of one or more materials.

Substrate 210 has central axis 215 as previously described and which generally defines the central axis of cutter element 200. In addition, substrate 210 has a first end 210*a* bonded to cutting layer 220 at plane of intersection 219, a second end 210*b* opposite end 210*a* and distal cutting layer 220, and a radially outer surface 212 extending axially between ends 210*a*, 210*b*. In this embodiment, substrate 210 is generally cylindrical, and thus, outer surface 212 is a cylindrical surface.

Figure 5:
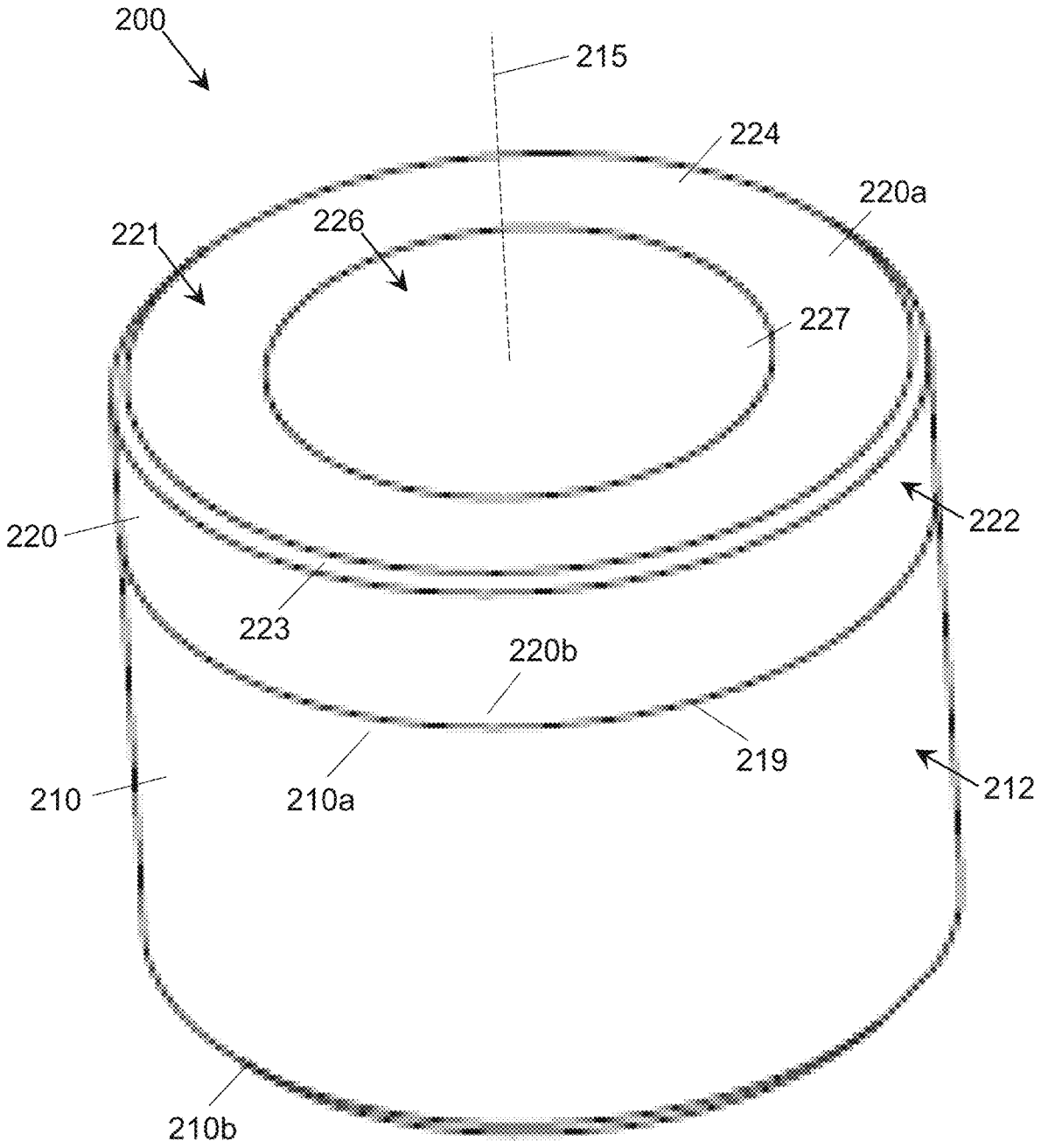
FIG. 5 is a perspective view of one of the cutter elements of the drill bit of FIG. 2.
Figure 6:
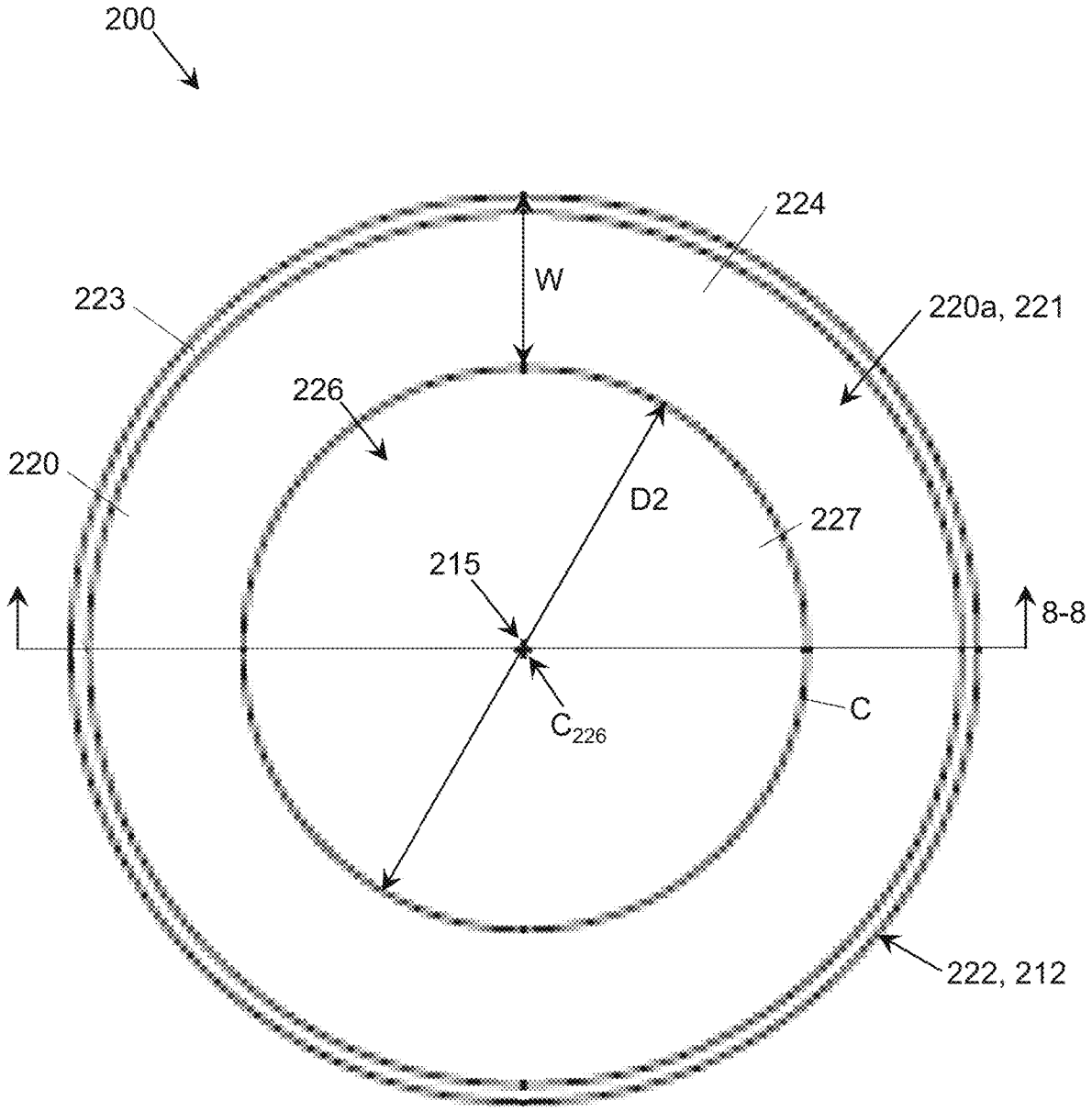
FIG. 6 is a top view of the cutter element of FIG. 5.
Figure 7:
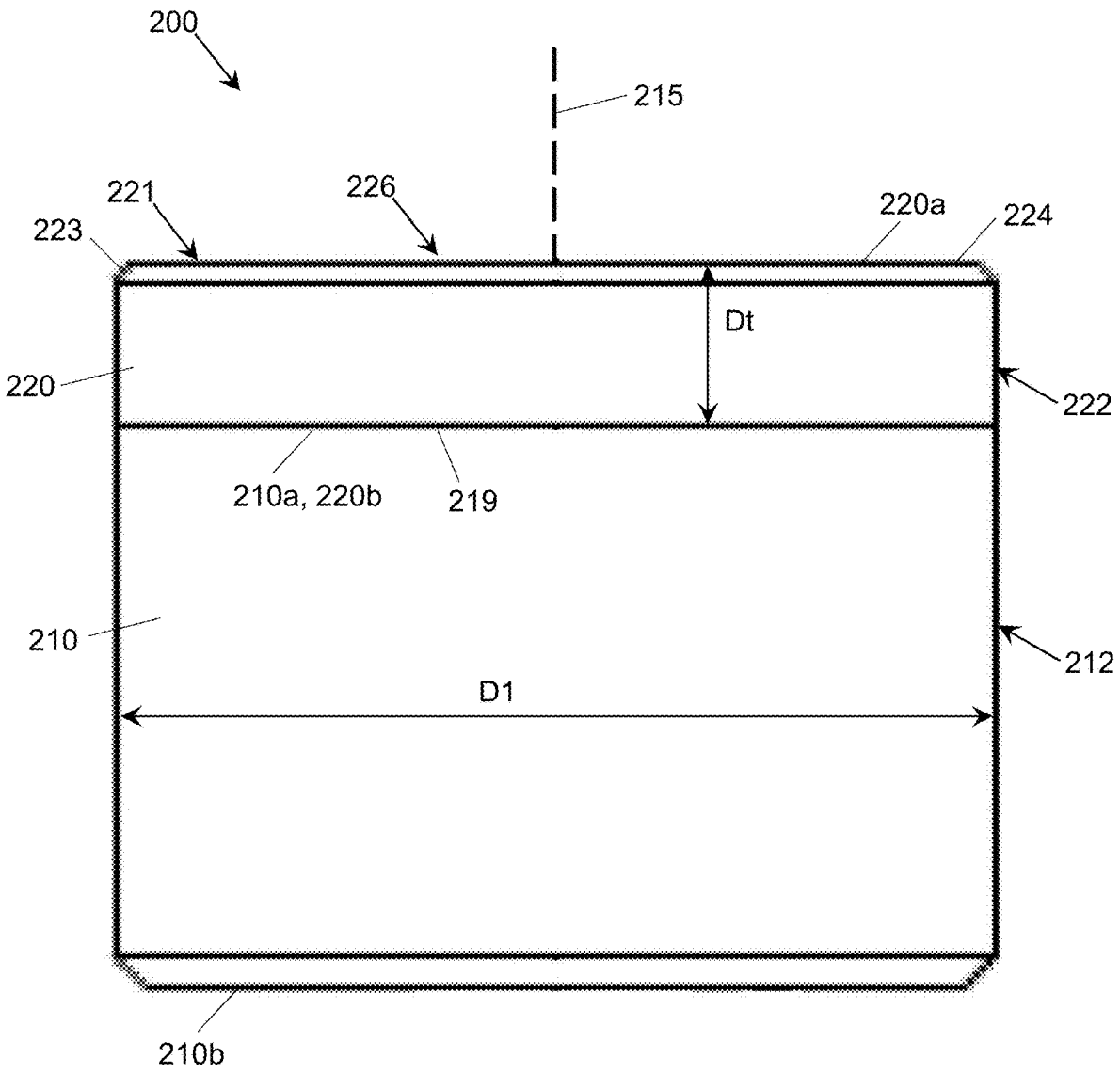
FIG. 7 is a side view of the cutter element of FIG. 5.

Referring still to FIGS. 5-7, cutting layer 220 has a first end 220*a* distal substrate 210, a second end 220*b* bonded to end 210*a* of substrate 210 at plane of intersection 219, and a radially outer surface 222 extending axially between ends 220*a*, 220*b*. In this embodiment, cutting layer 220 is generally disc-shaped, and thus, outer surface 222 is generally cylindrical. Outer surfaces 212, 222 of substrate 210 and cutting layer 220, respectively, are coextensive and contiguous such that there is a generally smooth transition moving axially between outer cylindrical surfaces 212, 222. Accordingly, substrate 210 and cutting layer 220 have the same outer diameter D1. In some embodiments, one or more circumferentially-spaced flats may be provided along the radially outer cylindrical surfaces (e.g., outer cylindrical surfaces 212, 222) and extending axially from the cutting face (e.g., cutting face 221).

The outer surface of cutting layer 220 at first end 220*a* defines cutting face 221 of cutter element 200, which is designed and shaped to engage and shear the formation during drilling operations. In this embodiment, a chamfer or bevel 223 is provided at the intersection of cutting face 221 and radially outer surface 222. In some embodiments, bevel 223 may comprise a frustoconical surface positioned between the cutting face 221 and radially outer surface 222. In some embodiments, bevel 223 may comprise an arcuate surface positioned between cutting face 221 and radially outer surface 222. Cutter element 200 and cutting face 221 are symmetric about central axis 215, such that cutting layer 220 is shaped as a right-circular cylinder. Thus, the cutting face 221 is generally circular in shape.

In this embodiment, cutting face 221 includes a planar surface 224 and a dimple or recess 226 in planar surface 224. Planar surface 224 is disposed in a plane oriented perpendicular to central axis 215, and recess 226 extends axially into planar surface 224 generally toward substrate 210. Thus, planar surface 224 defines the portion of cutting face 221 that is furthest or most distal substrate 210. Accordingly, cutting layer 220 has a thickness Dt measured axially from planar surface 224 to substrate 210 and plane of intersection 219.

Planar surface 224 extends circumferentially completely about recess 226. Accordingly, planar surface 224 is radially position between concave recess 226 and radially outer surface 222, and more specifically, planar surface 224 extends radially from recess 226 to radially outer surface 222. Therefore, planar surface 224 may also be described as defining the radially outer portion of cutting face 221 and concave recess 226 may also be described as defining the radially inner portion of cutting face 221. Planar surface 224 has a radial width W measured radially (i.e., perpendicular to axis 215) from concave recess 226 to radially outer surface 222 in top view (FIG. 6).

Figure 8:
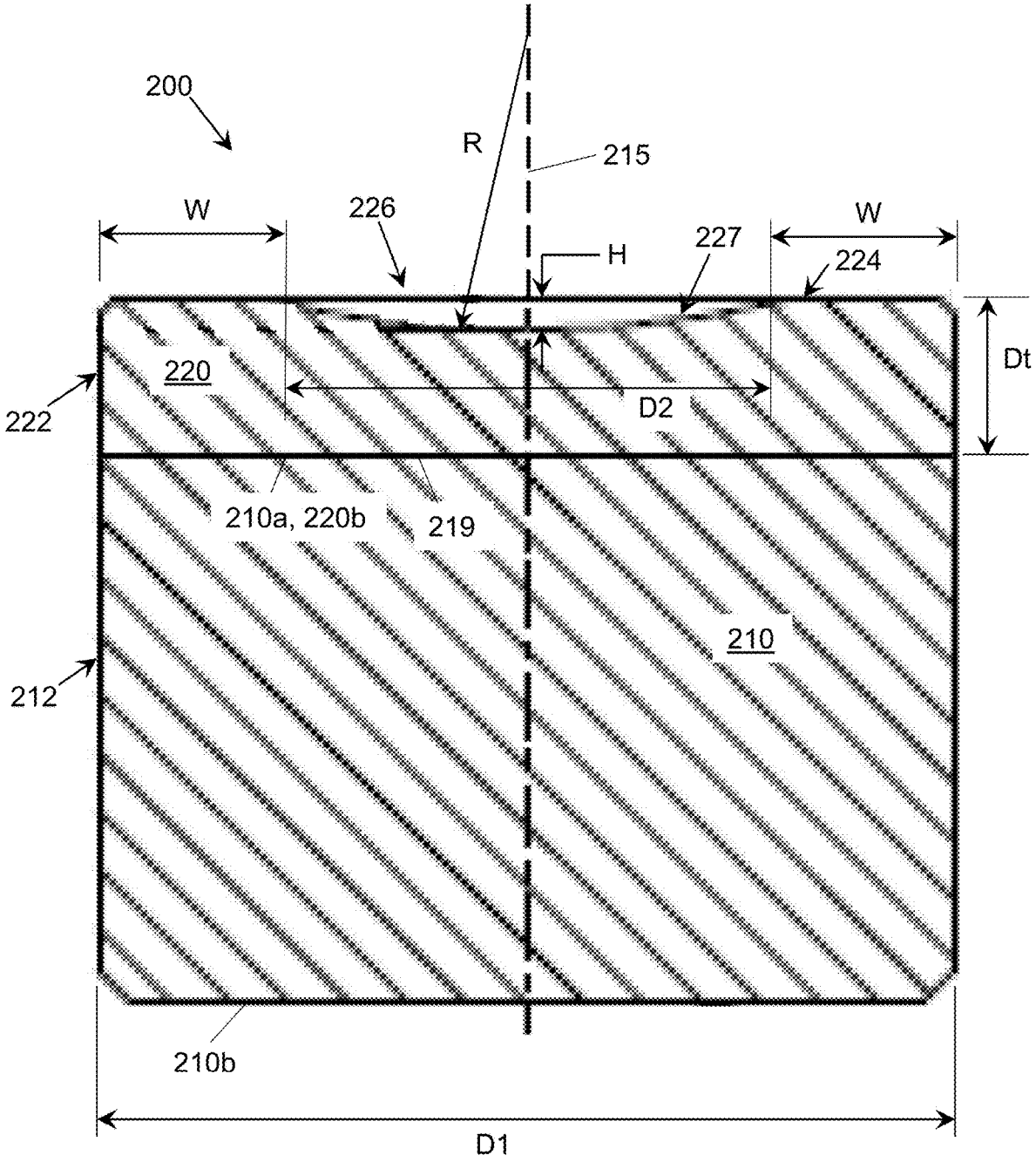
FIG. 8 is a cross-sectional view of the cutter element of FIG. 5 taken in section 8-8 of FIG. 6.
Figure 9:
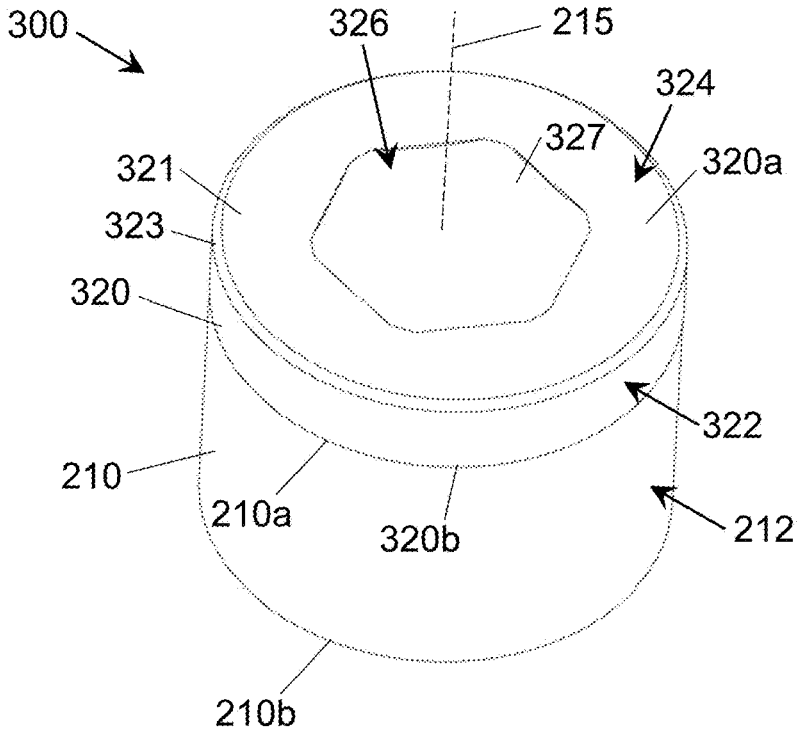
FIG. 9 is a perspective view of an embodiment of a cutter element for a fixed cutter drill bit in accordance with the principles described herein.

Referring still to FIGS. 5-8, in this embodiment, recess 226 is circular in top view of FIG. 5 (i.e., recess 226 has a circular profile in top view), and recess 226 is concentric with and centered relative to central axis 215 in top view (i.e., recess 226 has a geometric center $C_{226}$ that is intersected by central axis 215). As a result, the radial width W of planar surface 224 is constant moving circumferentially about central axis 215. As shown in FIG. 8, recess 226 has a maximum outer dimension D2 defined by the diameter of the smallest reference circle C disposed about and enclosing recess 226 in top view. As recess 226 is circular in top view, the maximum outer dimension D2 is the diameter of recess 226 in top view. As will be described in more detail below, in other embodiments, the concave recess in the cutting face (e.g., concave recess 226 in cutting face 221) may not be concentric with the central axis (e.g., central axis 215) and/or may have other geometries in top view including, without limitation, triangular, hexagonal, rectangular, etc.

Referring now to FIG. 8, as previously described, recess 226 extends axially into planar surface 224. In particular, recess 226 is defined by a smooth, continuously-contoured, concave (i.e., bowed inwardly) surface 227. Accordingly, recess 226 may also be described as being concave. As used herein, the term "continuously contoured" means and relates to surfaces that can be described as consisting of ridgeless surfaces that are free of abrupt changes in radii and free of relatively small radii (0.080 in. or smaller) as have conventionally been used in cutting elements to round off transitions between adjacent distinct surfaces or to "break" sharp edges. Thus, it should be appreciated that recess 226 and concave surface 227 do not include any planar surface(s), and hence, may be described as being free of planar surface(s).

Concave surface 227, and hence recess 226, extends to a depth H measured axially from the plane containing planar surface 224. The depth H generally increases moving radially inward from planar surface 224 along surface 227. In this embodiment, concave surface 227 is a spherical surface centered on central axis 215 and disposed a constant or uniform radius of curvature R moving from planar surface 224 and the outer perimeter of recess 226 to the geometric center $C_{226}$ of recess 226. As recess 226 is centered relative to central axis 215 in this embodiment, the radius of curvature R is measured from a point along central axis 215, and further, central axis 215 intersects the geometric center $C_{226}$ of recess 226. Thus, in this embodiment, the depth H is maximum at the intersection of concave surface 227 and central axis 215 at the geometric center $C_{226}$ of recess 226. Thus, in this embodiment, the depth H is maximum at a single point along concave surface 227. Although recess 226 is centered relative to central axis 215 and concave surface 227 is disposed at a constant radius of curvature R in this embodiment, in other embodiments, the recess (e.g., recess 226) may not be centered relative to the central axis of the substrate (e.g., central axis 215) and/or the continuously contoured, concave surface defining the recess (e.g., surface 227) may be continuously contoured but not disposed at a uniform or constant radius of curvature (e.g., radius of curvature R).

Cutter element 200 and cutting face 221 are generally designed and configured such that during drilling operations, planar surface 224, which is radially outside of concave recess 226, and bevel 223 directly engage and shear the formation, while drilling fluid enters and flows through concave recess 226, thereby minimizing and/or preventing contact between formation cuttings and concave surface 227 and offering the potential to improve cutting efficiency. Through substantial testing and analysis, it is believed that certain geometries and features of cutting face 221 offer particular benefits in improving the cutting efficiency. More specifically, in this embodiment, planar surface 224 is preferably smoother than concave surface 227. In other words, the average surface roughness Ra of planar surface 224 is preferably less than the average surface roughness Ra of the concave surface 227. In general, the average surface roughness Ra of planar surface 224 preferably ranges from 0.02 micron to 1.20 micron, alternatively ranging from 0.05 micron to 0.80 micron, and alternatively ranging from 0.05 micron to 0.60 micron; and the average surface roughness Ra of concave surface 227 defining recess 226 preferably has an average surface roughness Ra ranging from 0.06 micron to 2.00 micron, alternatively ranging from 0.5 micron to 2.0 micron, and alternatively ranging from 0.80 micron to 1.60 micron. In addition, the ratio of the maximum depth H to the outer diameter D1 of cutter element 200 preferably ranges from 0.01 to 0.09, and alternatively ranges from 0.20 to 0.80; the ratio of the radius of curvature R of concave surface 227 to the outer diameter D1 of cutter element 200 preferably ranges from 0.80 to 2.00, and alternatively ranges from 1.00 to 1.80; the ratio of the radial width W of planar surface 224 to the outer diameter D1 of the cutter element 200 preferably ranges from 0.05 to 0.50, and alternatively ranges from 0.06 to 0.40; the ratio of the radius of curvature R of concave surface 227 to the radial width W of planar surface 224 preferably ranges from 5.00 to 9.00 and alternatively ranges from 5.50 to 8.50; and the ratio of the maximum depth H to the thickness Dt of cutting layer 220 preferably ranges from 0.05 to 0.36, and alternatively ranges from 0.06 to 0.30. Still further, for a cutter element 200 having an outer diameter D1 ranging from 11.00 mm to 25.00 mm, the maximum depth H preferably ranges from 0.20 mm to 1.60 mm, and alternatively ranges from 0.30 mm to 1.40 mm; the radius of curvature R preferably ranges from 10.00 mm to 40.00 mm, and alternatively ranges from 12.00 mm to 36.00 mm; the radial width W of planar surface 224 preferably ranges from 1.50 mm to 5.00 mm, and alternatively ranges from 1.80 mm to 4.80 mm; and the maximum outer dimension D2 of concave recess 226 preferably ranges from 3.00 mm to 16.0 mm, and alternatively ranges from 3.3 mm to 14.6 mm. It should be appreciated that any one of the foregoing geometries, geometrical relationships, and features can be employed alone or in connection with any one or more of the other geometries, geometrical relationships, and features.

Referring now to FIGS. 9-12, an embodiment of a cutter element 300 that can be used in place of cutter element 200 in drill bit 100 is shown. Cutter element 300 is similar to cutter element 200 previously described. In particular, cutter element 300 includes a base or substrate 210 as previously described and cutting disc or layer 320 bonded to the substrate 210. Cutting layer 320 and substrate 210 meet at a reference plane of intersection 219 that defines the location at which substrate 210 and cutting layer 320 are fixably attached.

Cutting layer 320 is similar to cutting layer 220 previously described. In particular, cutting layer 320 is made of an ultrahard material such as polycrystalline diamond (PCD) or other superabrasive material. Part or all of the diamond in cutting layer 320 may be leached, finished, polished, or otherwise treated to enhance durability, efficiency or effectiveness. While cutting layer 320 is shown as a single layer of material mounted to substrate 210, in general, the cutting layer (for example, layer 320) may be formed of one or more layers of one or more materials. In addition, cutting layer 320 has a first end 320*a* distal substrate 210, a second end 320*b* bonded to end 210*a* of substrate 210 at plane of intersection 219, and a radially outer surface 322 extending axially between ends 320*a*, 320*b*. In this embodiment, cutting layer 320 is generally disc-shaped, and thus, outer surface 322 is generally cylindrical. Outer surfaces 212, 322 of substrate 210 and cutting layer 320, respectively, are coextensive and contiguous such that there is a generally smooth transition moving axially between outer cylindrical surfaces 212, 322. Accordingly, substrate 210 and cutting layer 320 have the same outer diameter D1. In some embodiments, one or more circumferentially-spaced flats may be provided along the radially outer cylindrical surfaces (e.g., outer cylindrical surfaces 212, 322) and extending axially from the first end of the cutting layer (e.g., end 320*a* of cutting layer 320).

The outer surface of cutting layer 320 at first end 320*a* defines a cutting face 321 of cutter element 300, which is designed and shaped to engage and shear the formation during drilling operations. In this embodiment, a chamfer or bevel 323 is provided at the intersection of cutting face 321 and radially outer surface 322. In some embodiments, bevel 323 may comprise a frustoconical surface extending between the cutting face 321 and radially outer surface 322. In some embodiments, bevel 323 may comprise an arcuate surface extending between cutting face 321 and radially outer surface 322. Cutter element 300 and cutting face 321 are symmetric about central axis 215, such that cutting layer 320 is shaped as a right-circular cylinder. Thus, the cutting face 321 is generally circular in shape.

In this embodiment, cutting face 321 includes a planar surface 324 and a dimple or recess 326 in planar surface 324. Planar surface 324 is disposed in a plane oriented perpendicular to central axis 215, and recess 326 extends axially into planar surface 324 generally toward substrate 210. Thus, planar surface 324 defines the portion of cutting face 321 that is furthest or most distal substrate 210. Accordingly, cutting layer 320 has a thickness Dt measured axially from planar surface 324 to substrate 210 and plane of intersection 219 as shown in FIG. 12.

Planar surface 324 extends circumferentially completely about recess 326. Accordingly, planar surface 324 is radially position between concave recess 326 and radially outer surface 322, and more specifically, planar surface 324 extends radially from recess 326 to radially outer surface 322. Therefore, planar surface 324 may also be described as defining the radially outer portion of cutting face 321 and concave recess 326 may also be described as defining the radially inner portion of cutting face 321. Planar surface 324 has a radial width W measured radially (i.e., perpendicular to axis 215) from concave recess 326 to radially outer surface 322 in top view (FIG. 10).

Figure 10:
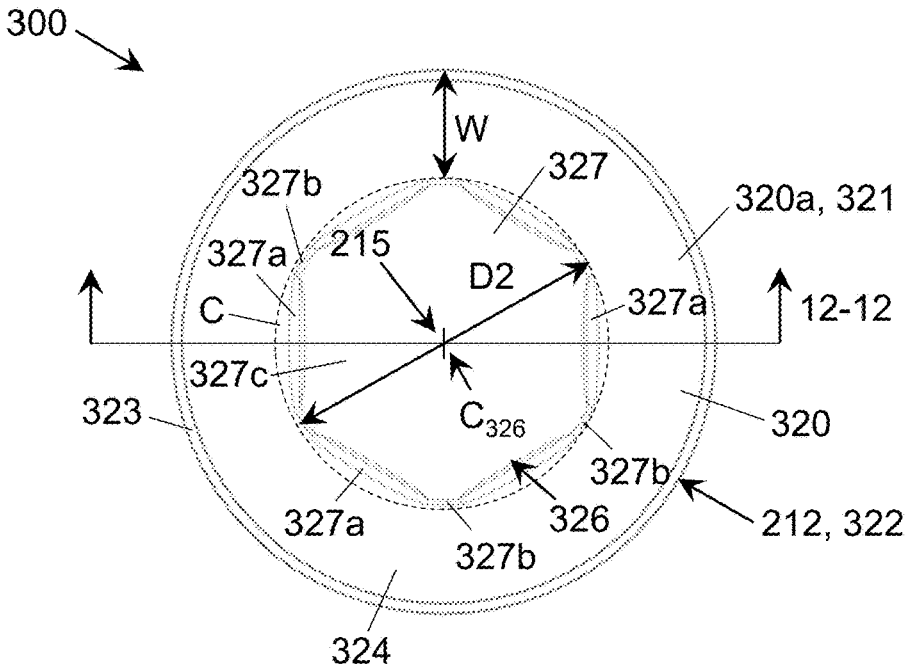
FIG. 10 is a top view of the cutter element of FIG. 9.
Figure 11:
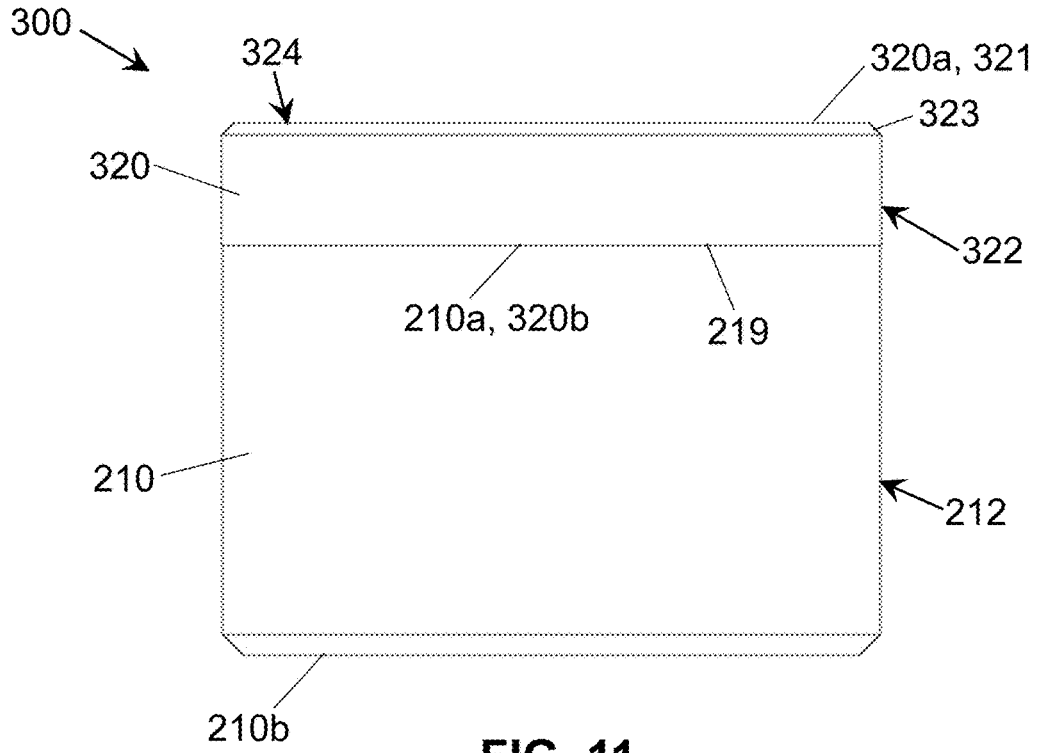
FIG. 11 is a side view of the cutter element of FIG. 9.

Referring still to FIGS. 9-12, in this embodiment, recess 326 is concentric with and centered relative to central axis 215 (i.e., recess 326 has a geometric center $C_{326}$ that is intersected by central axis 215). However, unlike recess 226 of cutter element 200 previously described, in this embodiment, recess 326 is not circular in top view as shown in FIG. 10 (i.e., recess 326 does not have a circular profile in top view). Rather, in this embodiment, recess 326 is hexagonal in top view of FIG. 10 (i.e., recess 326 has a hexagonal outer profile in top view). As a result, the radial width W of planar surface 324 is not constant, but varies moving circumferentially about central axis 215. As shown in FIG. 10, recess 326 has a maximum outer dimension D2 defined by the diameter of the smallest reference circle C disposed about and enclosing recess 326 in top view.

Figure 12:
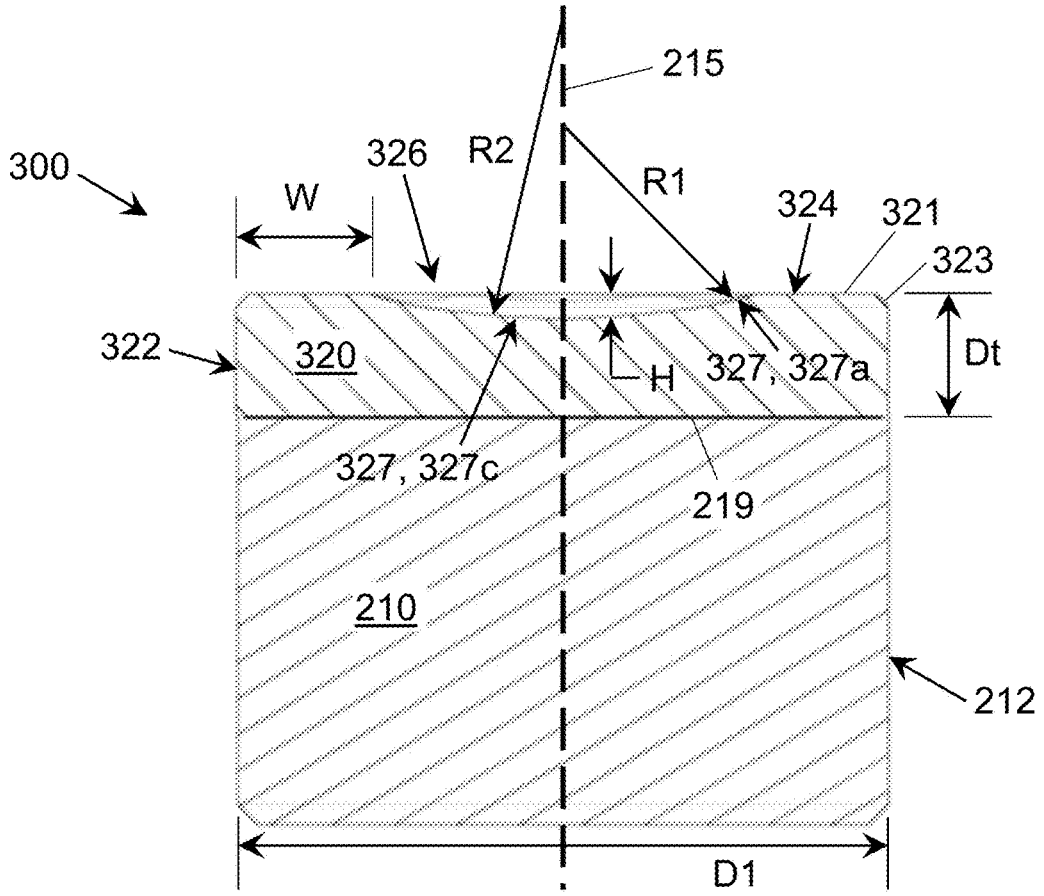
FIG. 12 is a cross-sectional view of the cutter element of FIG. 9 taken in section 12-12 of FIG. 10.

Referring now to FIG. 12, as previously described, recess 326 extends axially into planar surface 324. In particular, recess 326 is defined by a smooth, continuously-contoured, concave (i.e., bowed inwardly) surface 327. Accordingly, recess 326 may also be described as being concave. Thus, it should be appreciated that recess 326 and concave surface 327 do not include any planar surface(s), and hence, may be described as being free of planar surface(s).

Concave surface 327, and hence recess 326, extends to a depth H measured axially from the plane containing planar surface 324. In this embodiment, concave surface 327 is disposed at and defined by two different radii of curvature R1, R2. In particular, concave surface 327 includes a plurality of circumferentially-spaced radially outer portions 327*a* extending from planar surface 324 along the straight sides of hexagonal recess 326, a plurality of circumferentially-spaced radially outer portions 327*b* extending from planar surface 324 along the curved corners or vertices of hexagonal recess 326, and a radially inner portion 327*c* extending radially inward from portions 327*a*, 327*b* to geometric center $C_{326}$ of hexagonal recess 326. As best shown in the top view of FIG. 10, outer portions 327*a*, 327*b* are circumferentially arranged in an alternating fashion about radially inner portion 327*c* along the outer perimeter of hexagonal recess 326. In other words, one outer portion 327*a* is disposed between and extends between each pair of circumferentially adjacent outer portions 327*b*. Each outer portion 327*a*, 327*b* of concave surface 327 is disposed at a constant or uniform radius of curvature R1, and inner portion 327*c* is disposed at a constant or uniform radius of curvature R2. In this embodiment, radius of curvature R1 is less than the radius of curvature R2. Although outer portions 327*a*, 327*b* are disposed at a different radius of curvature R1 as compared to inner portion 327*c* disposed at radius of curvature R2, each outer portion 327*a*, 327*b* smoothly transitions into inner portion 327*c* such that concave surface 327 is continuously-contoured. As recess 326 is centered relative to central axis 215 in this embodiment, each radius of curvature R1, R2 is measured from a point along central axis 215. Thus, the depth H generally increases moving radially inward from planar surface 324 along surface 327 to geometric center $C_{326}$ and central axis 215, and further, the depth H is maximum at the intersection of concave surface 327 and central axis 215 (i.e., at geometric center $C_{326}$). Thus, in this embodiment, the depth H is maximum at a single point along concave surface 327. Although recess 326 is centered relative to central axis 215 in this embodiment, in other embodiments, the recess (e.g., recess 326) may not be centered relative to the central axis of the substrate (e.g., central axis 215).

Cutter element 300 and cutting face 321 generally function in the same manner as cutter element 200 and cutting face 221, respectively, as previously described. Namely, cutter element 300 and cutting face 321 are generally designed and configured such that during drilling operations, planar surface 324, which is radially outside of concave recess 326, and bevel 323 directly engage and shear the formation, while drilling fluid enters and flows through concave recess 326, thereby minimizing and/or preventing contact between formation cuttings and concave surface 327 and offering the potential to improve cutting efficiency. Through substantial testing and analysis, it is believed that certain geometries and features of cutting face 321 offer particular benefits in improving the cutting efficiency. More specifically, planar surface 324 is preferably smoother than concave surface 327. In other words, the average surface roughness Ra of planar surface 324 is preferably less than the average surface roughness Ra of the concave surface 327. In general, the average surface roughness Ra of planar surface 324 preferably ranges from 0.02 micron to 1.20 micron, alternatively ranging from 0.05 micron to 0.80 micron, and alternatively ranging from 0.05 micron to 0.60 micron; and the average surface roughness Ra of concave surface 327 defining recess 326 preferably has an average surface roughness Ra ranging from 0.06 micron to 2.00 micron, alternatively ranging from 0.5 micron to 2.0 micron, and alternatively ranging from 0.80 micron to 1.60 micron. In addition, the ratio of the maximum depth H to the outer diameter D1 of cutter element 300 preferably ranges from 0.01 to 0.09, and alternatively ranges from 0.20 to 0.80; the ratio of each radius of curvature R1, R2 of concave surface 327 to the outer diameter D1 of cutter element 300 preferably ranges from 0.80 to 2.00, and alternatively ranges from 1.00 to 1.80; the ratio of the radial width W of planar surface 324 to the outer diameter D1 of the cutter element 300 preferably ranges from 0.05 to 0.50, and alternatively ranges from 0.06 to 0.40; the ratio of each radius of curvature R1, R2 of concave surface 327 to the radial width W of planar surface 324 preferably ranges from 5.00 to 9.00 and alternatively ranges from 5.50 to 8.50; and the ratio of the maximum depth H to the thickness Dt of cutting layer 320 preferably ranges from 0.05 to 0.36, and alternatively ranges from 0.06 to 0.30. Still further, for a cutter element 300 having an outer diameter D1 ranging from 11.00 mm to 25.00 mm, the maximum depth H preferably ranges from 0.20 mm to 1.60 mm, and alternatively ranges from 0.30 mm to 1.40 mm; each radius of curvature R1, R2 preferably ranges from 10.00 mm to 40.00 mm, and alternatively ranges from 12.00 mm to 36.00 mm; the radial width W of planar surface 324 preferably ranges from 1.50 mm to 5.00 mm, and alternatively ranges from 1.80 mm to 4.80 mm; and the maximum outer dimension D2 of concave recess 326 preferably ranges from 3.00 mm to 16.0 mm, and alternatively ranges from 3.3 mm to 14.6 mm. It should be appreciated that any one of the foregoing geometries, geometrical relationships, and features can be employed alone or in connection with any one or more of the other geometries, geometrical relationships, and features.

Referring now to FIGS. 13-16, an embodiment of a cutter element 400 that can be used in place of cutter element 200 in drill bit 100 is shown. Cutter element 400 is similar to cutter element 200 previously described. In particular, cutter element 400 includes a base or substrate 210 as previously described and cutting disc or layer 420 bonded to the substrate 210. Cutting layer 420 and substrate 210 meet at a reference plane of intersection 219 that defines the location at which substrate 210 and cutting layer 420 are fixably attached.

Cutting layer 420 is similar to cutting layer 220 previously described. In particular, cutting layer 420 is made of an ultrahard material such as polycrystalline diamond (PCD) or other superabrasive material. Part or all of the diamond in cutting layer 420 may be leached, finished, polished, or otherwise treated to enhance durability, efficiency or effectiveness. While cutting layer 420 is shown as a single layer of material mounted to substrate 210, in general, the cutting layer (for example, layer 420) may be formed of one or more layers of one or more materials. In addition, cutting layer 420 has a first end 420*a* distal substrate 210, a second end 420*b* bonded to end 210*a* of substrate 210 at plane of intersection 219, and a radially outer surface 422 extending axially between ends 420*a*, 420*b*. In this embodiment, cutting layer 420 is generally disc-shaped, and thus, outer surface 422 is generally cylindrical. Outer surfaces 212, 422 of substrate 210 and cutting layer 420, respectively, are coextensive and contiguous such that there is a generally smooth transition moving axially between outer cylindrical surfaces 212, 422. Accordingly, substrate 210 and cutting layer 420 have the same outer diameter D1. In some embodiments, one or more circumferentially-spaced flats may be provided along the radially outer cylindrical surfaces (e.g., outer cylindrical surfaces 212, 422) and extending axially from the first end of the cutting layer (e.g., end 420*a* of cutting layer 420).

The outer surface of cutting layer 420 at first end 420*a* defines a cutting face 421 of cutter element 400, which is designed and shaped to engage and shear the formation during drilling operations. In this embodiment, a chamfer or bevel 423 is provided at the intersection of cutting face 421 and radially outer surface 422. In some embodiments, bevel 423 may comprise a frustoconical surface extending between the cutting face 421 and radially outer surface 422. In some embodiments, bevel 423 may comprise an arcuate surface extending between cutting face 421 and radially outer surface 422. Cutter element 400 and cutting face 421 are symmetric about central axis 215, such that cutting layer 420 is shaped as a right-circular cylinder. Thus, the cutting face 421 is generally circular in shape.

In this embodiment, cutting face 421 includes a planar surface 424 and a dimple or recess 426 in planar surface 424. Planar surface 424 is disposed in a plane oriented perpendicular to central axis 215, and recess 426 extends axially into planar surface 424 generally toward substrate 210. Thus, planar surface 424 defines the portion of cutting face 421 that is furthest or most distal substrate 210. Accordingly, cutting layer 420 has a thickness Dt measured axially from planar surface 424 to substrate 210 and plane of intersection 219 as shown in FIG. 16.

Planar surface 424 extends circumferentially completely about recess 426. Accordingly, planar surface 424 is radially position between concave recess 426 and radially outer surface 422, and more specifically, planar surface 424 extends radially from recess 426 to radially outer surface 422. Therefore, planar surface 424 may also be described as defining the radially outer portion of cutting face 421 and concave recess 426 may also be described as defining the radially inner portion of cutting face 421. Planar surface 424 has a radial width W measured radially (i.e., perpendicular to axis 215) from concave recess 426 to radially outer surface 422 in top view (FIG. 14).

Figure 13:
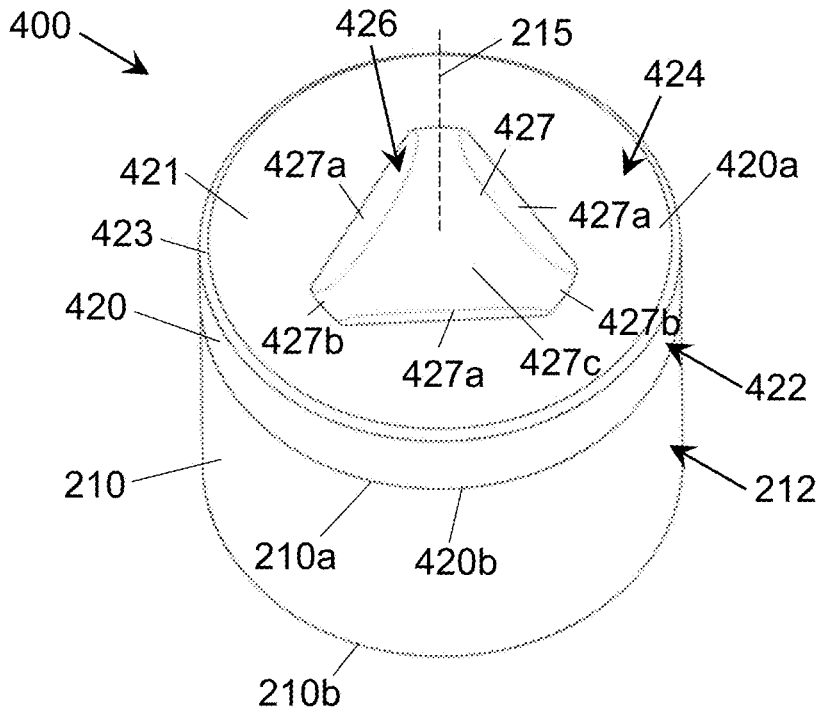
FIG. 13 is a perspective view of an embodiment of a cutter element for a fixed cutter drill bit in accordance with the principles described herein.
Figure 14:
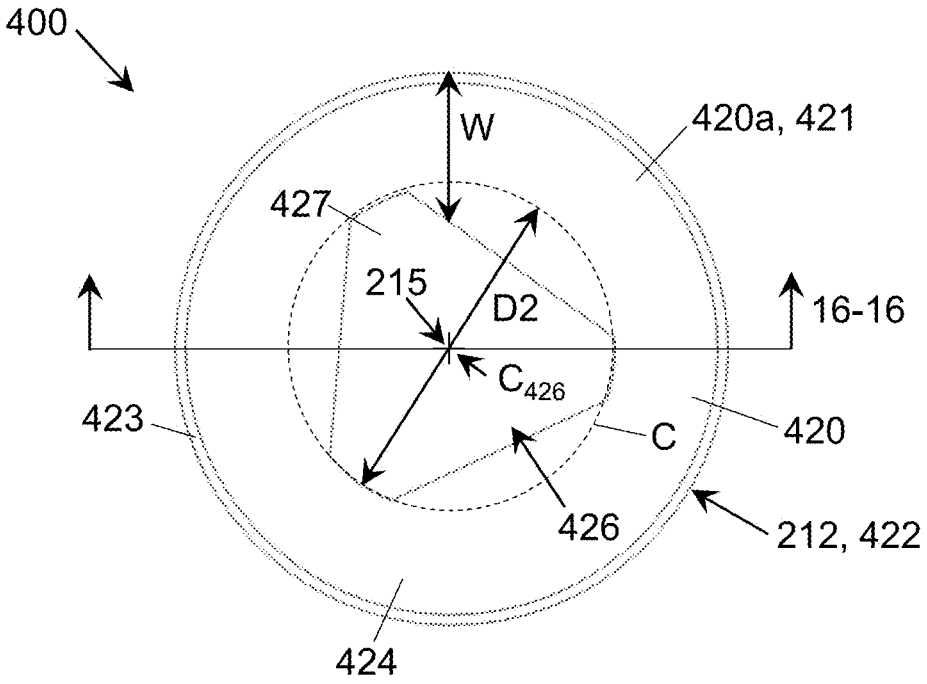
FIG. 14 is a top view of the cutter element of FIG. 13.
Figure 15:
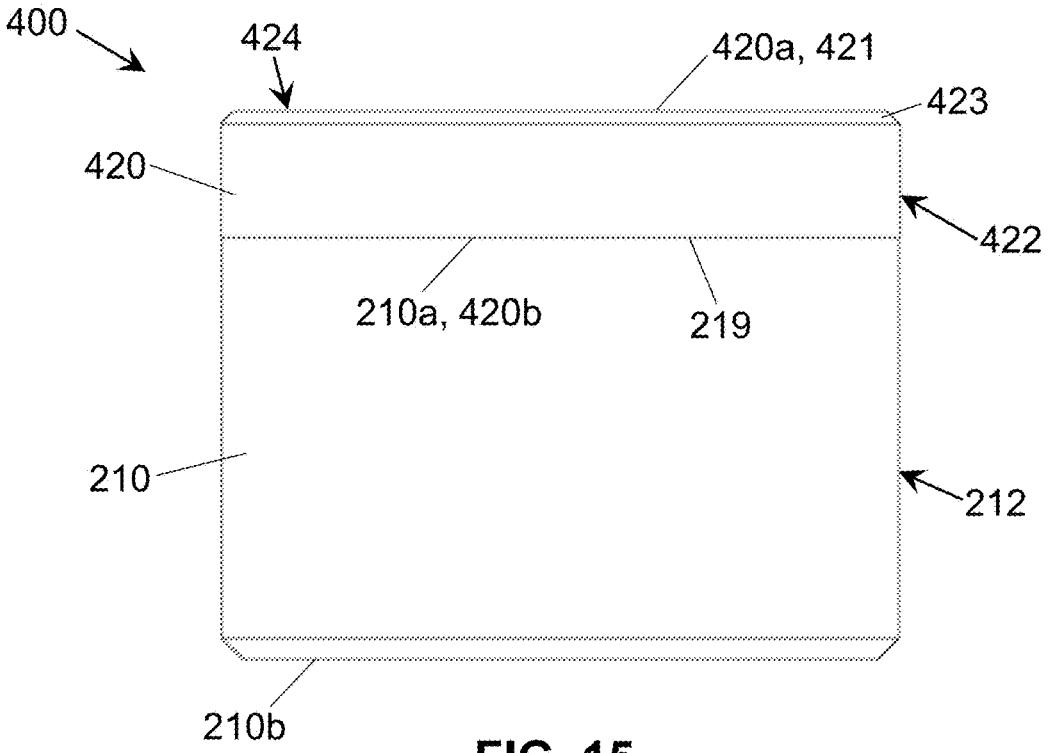
FIG. 15 is a side view of the cutter element of FIG. 13.

Referring still to FIGS. 13-16, in this embodiment, recess 426 is centered relative to central axis 215 in top view (i.e., recess 426 has a geometric center $C_{426}$ in top view that is intersected by axis 215). However, unlike recess 226 of cutter element 200 previously described, in this embodiment, recess 426 is not circular in top view as shown in FIG. 14 (i.e., recess 426 does not have a circular profile in top view). Rather, in this embodiment, recess 426 is generally triangular, and more specifically, triangular with rounded corners or vertices, in top view of FIG. 14 (i.e., recess 426 has a generally triangular outer profile in top view). As a result, the radial width W of planar surface 424 is not constant, but varies moving circumferentially about central axis 215. As shown in FIG. 14, recess 426 has a maximum outer dimension D2 defined by the diameter of the smallest reference circle C disposed about and enclosing recess 426 in top view.

Figure 16:
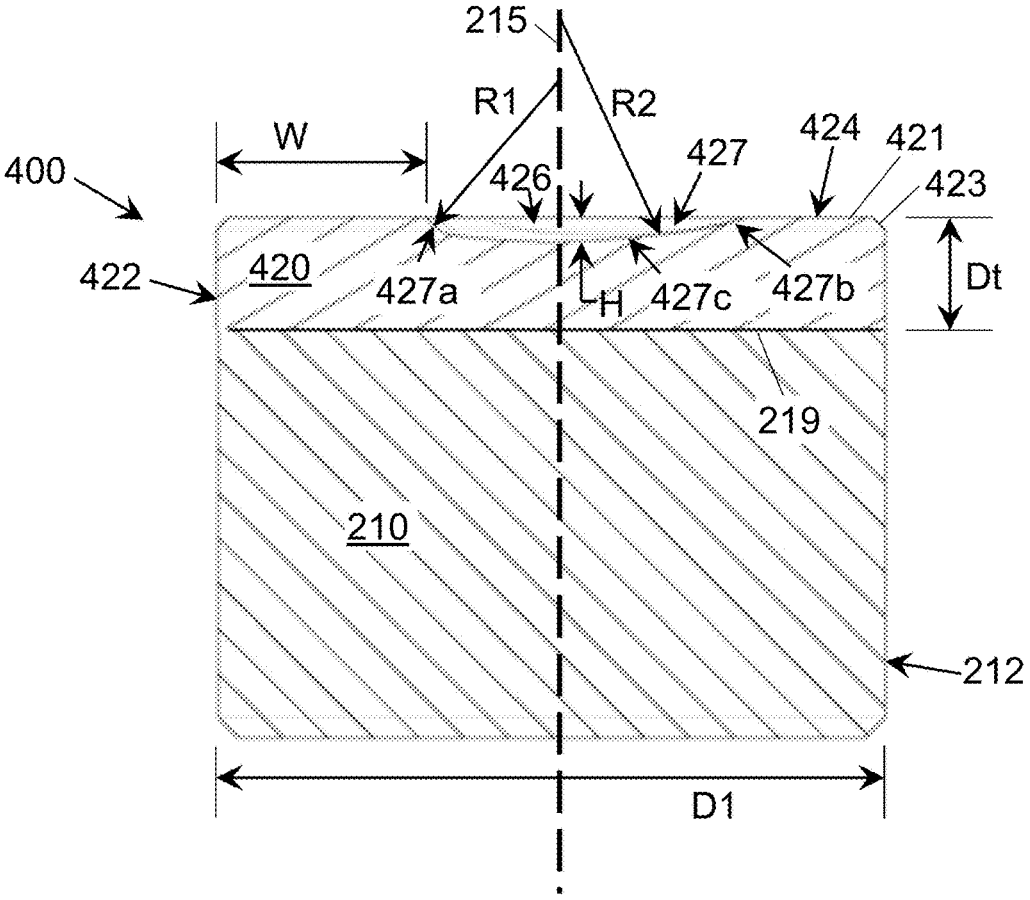
FIG. 16 is a cross-sectional view of the cutter element of FIG. 13 taken in section 16-16 of FIG. 14.

Referring now to FIG. 16, as previously described, recess 426 extends axially into planar surface 424. More specifically, recess 426 is defined by a smooth, continuously-contoured, concave (i.e., bowed inwardly) surface 427. Accordingly, recess 426 may also be described as being concave. Thus, it should be appreciated that recess 426 and concave surface 427 do not include any planar surface(s), and hence, may be described as being free of planar surface(s).

Concave surface 427, and hence recess 426, extends to a depth H measured axially from the plane containing planar surface 424. In this embodiment, concave surface 427 is disposed at and defined by two different radii of curvature R1, R2. In particular, concave surface 427 includes a plurality of circumferentially-spaced radially outer portions 427*a* extending from planar surface 424 along the straight sides of triangular recess 426, a plurality of circumferentially-spaced radially outer portions 427*b* extending from planar surface 424 along the curved corners or vertices of triangular recess 426, and a radially inner portion 427*c* extending radially inward from portions 427*a*, 427*b* to geometric center $C_{426}$ of triangular recess 426. As best shown in FIG. 13, outer portions 427*a*, 427*b* are circumferentially arranged in an alternating fashion about radially inner portion 427*c* along the outer perimeter of triangular recess 426. In other words, one outer portion 427*a* is disposed between and extends between each pair of circumferentially adjacent outer portions 427*b*. Each outer portion 427*a*, 427*b* of concave surface 427 is disposed at a constant or uniform radius of curvature R1, and inner portion 427*c* is disposed at a constant or uniform radius of curvature R2. In this embodiment, radius of curvature R1 is less than the radius of curvature R2. Although outer portions 427*a*, 427*b* are disposed at a different radius of curvature R1 as compared to inner portion 427*c* disposed at radius of curvature R2, each outer portion 427*a*, 427*b* smoothly transitions into inner portion 427*c* such that concave surface 427 is continuously-contoured. As recess 426 is centered relative to central axis 215 in this embodiment, each radius of curvature R1, R2 is measured from a point along central axis 215. Thus, the depth H generally increases moving radially inward from planar surface 424 along surface 427 to geometric center $C_{426}$ and central axis 215, and further, the depth H is maximum at the intersection of concave surface 427 and central axis 215 (i.e., at geometric center $C_{426}$). Thus, in this embodiment, the depth H is maximum at a single point along concave surface 427. Although recess 426 is centered relative to central axis 215 in this embodiment, in other embodiments, the recess (e.g., recess 426) may not be centered relative to the central axis of the substrate (e.g., central axis 215).

Cutter element 400 and cutting face 421 generally function in the same manner as cutter element 200 and cutting face 221, respectively, as previously described. Namely, cutter element 400 and cutting face 421 are generally designed and configured such that during drilling operations, planar surface 424, which is radially outside of concave recess 426, and bevel 423 directly engage and shear the formation, while drilling fluid enters and flows through concave recess 426, thereby minimizing and/or preventing contact between formation cuttings and concave surface 427 and offering the potential to improve cutting efficiency. Through substantial testing and analysis, it is believed that certain geometries and features of cutting face 421 offer particular benefits in improving the cutting efficiency. More specifically, planar surface 424 is preferably smoother than concave surface 427. In other words, the average surface roughness Ra of planar surface 424 is preferably less than the average surface roughness Ra of the concave surface 427. In general, the average surface roughness Ra of planar surface 424 preferably ranges from 0.02 micron to 1.20 micron, alternatively ranging from 0.05 micron to 0.80 micron, and alternatively ranging from 0.05 micron to 0.60 micron; and the average surface roughness Ra of concave surface 427 defining recess 426 preferably has an average surface roughness Ra ranging from 0.06 micron to 2.00 micron, alternatively ranging from 0.5 micron to 2.0 micron, and alternatively ranging from 0.80 micron to 1.60 micron. In addition, the ratio of the maximum depth H to the outer diameter D1 of cutter element 400 preferably ranges from 0.01 to 0.09, and alternatively ranges from 0.20 to 0.80; the ratio of each radius of curvature R1, R2 of concave surface 427 to the outer diameter D1 of cutter element 400 preferably ranges from 0.80 to 2.00, and alternatively ranges from 1.00 to 1.80; the ratio of the radial width W of planar surface 424 to the outer diameter D1 of the cutter element 400 preferably ranges from 0.05 to 0.50, and alternatively ranges from 0.06 to 0.40; the ratio of each radius of curvature R1, R2 of concave surface 427 to the radial width W of planar surface 424 preferably ranges from 5.00 to 9.00 and alternatively ranges from 5.50 to 8.50; and the ratio of the maximum depth H to the thickness Dt of cutting layer 420 preferably ranges from 0.05 to 0.36, and alternatively ranges from 0.06 to 0.30. Still further, for a cutter element 400 having an outer diameter D1 ranging from 11.00 mm to 25.00 mm, the maximum depth H preferably ranges from 0.20 mm to 1.60 mm, and alternatively ranges from 0.30 mm to 1.40 mm; each radius of curvature R1, R2 preferably ranges from 10.00 mm to 40.00 mm, and alternatively ranges from 12.00 mm to 36.00 mm; the radial width W of planar surface 424 preferably ranges from 1.50 mm to 5.00 mm, and alternatively ranges from 1.80 mm to 4.80 mm; and the maximum outer dimension D2 of concave recess 426 preferably ranges from 3.00 mm to 16.0 mm, and alternatively ranges from 3.3 mm to 14.6 mm. It should be appreciated that any one of the foregoing geometries, geometrical relationships, and features can be employed alone or in connection with any one or more of the other geometries, geometrical relationships, and features.

Referring now to FIGS. 17-20, an embodiment of a cutter element 500 that can be used in place of cutter element 200 in drill bit 100 is shown. Cutter element 500 is similar to cutter element 200 previously described. In particular, cutter element 500 includes a base or substrate 210 as previously described and cutting disc or layer 520 bonded to the substrate 210. Cutting layer 520 and substrate 210 meet at a reference plane of intersection 219 that defines the location at which substrate 210 and cutting layer 520 are fixably attached.

Cutting layer 520 is similar to cutting layer 220 previously described. In particular, cutting layer 520 is made of an ultrahard material such as polycrystalline diamond (PCD) or other superabrasive material. Part or all of the diamond in cutting layer 520 may be leached, finished, polished, or otherwise treated to enhance durability, efficiency or effectiveness. While cutting layer 520 is shown as a single layer of material mounted to substrate 210, in general, the cutting layer (for example, layer 520) may be formed of one or more layers of one or more materials. In addition, cutting layer 520 has a first end 520*a* distal substrate 210, a second end 520*b* bonded to end 210*a* of substrate 210 at plane of intersection 219, and a radially outer surface 522 extending axially between ends 520*a*, 520*b*. In this embodiment, cutting layer 520 is generally disc-shaped, and thus, outer surface 522 is generally cylindrical. Outer surfaces 212, 522 of substrate 210 and cutting layer 520, respectively, are coextensive and contiguous such that there is a generally smooth transition moving axially between outer cylindrical surfaces 212, 522. Accordingly, substrate 210 and cutting layer 520 have the same outer diameter D1. In some embodiments, one or more circumferentially-spaced flats may be provided along the radially outer cylindrical surfaces (e.g., outer cylindrical surfaces 212, 522) and extending axially from the first end of the cutting layer (e.g., end 520*a* of cutting layer 520).

The outer surface of cutting layer 520 at first end 520*a* defines a cutting face 521 of cutter element 500, which is designed and shaped to engage and shear the formation during drilling operations. In this embodiment, a chamfer or bevel 523 is provided at the intersection of cutting face 521 and radially outer surface 522. In some embodiments, bevel 523 may comprise a frustoconical surface extending between the cutting face 521 and radially outer surface 522. In some embodiments, bevel 523 may comprise an arcuate surface extending between cutting face 521 and radially outer surface 522. Cutter element 500 and cutting face 521 are symmetric about central axis 215, such that cutting layer 520 is shaped as a right-circular cylinder. Thus, the cutting face 521 is generally circular in shape.

In this embodiment, cutting face 521 includes a planar surface 524 and a dimple or recess 526 in planar surface 524. Planar surface 524 is disposed in a plane oriented perpendicular to central axis 215, and recess 526 extends axially into planar surface 524 generally toward substrate 210. Thus, planar surface 524 defines the portion of cutting face 521 that is furthest or most distal substrate 210. Accordingly, cutting layer 520 has a thickness Dt measured axially from planar surface 524 to substrate 210 and plane of intersection 219 as shown in FIG. 20.

Planar surface 524 extends circumferentially completely about recess 526. Accordingly, planar surface 524 is radially position between concave recess 526 and radially outer surface 522, and more specifically, planar surface 524 extends radially from recess 526 to radially outer surface 522. Therefore, planar surface 524 may also be described as defining the radially outer portion of cutting face 521 and concave recess 526 may also be described as defining the radially inner portion of cutting face 521. Planar surface 524 has a radial width W measured radially (i.e., perpendicular to axis 215) from concave recess 526 to radially outer surface 522 in top view (FIG. 18).

Figure 17:
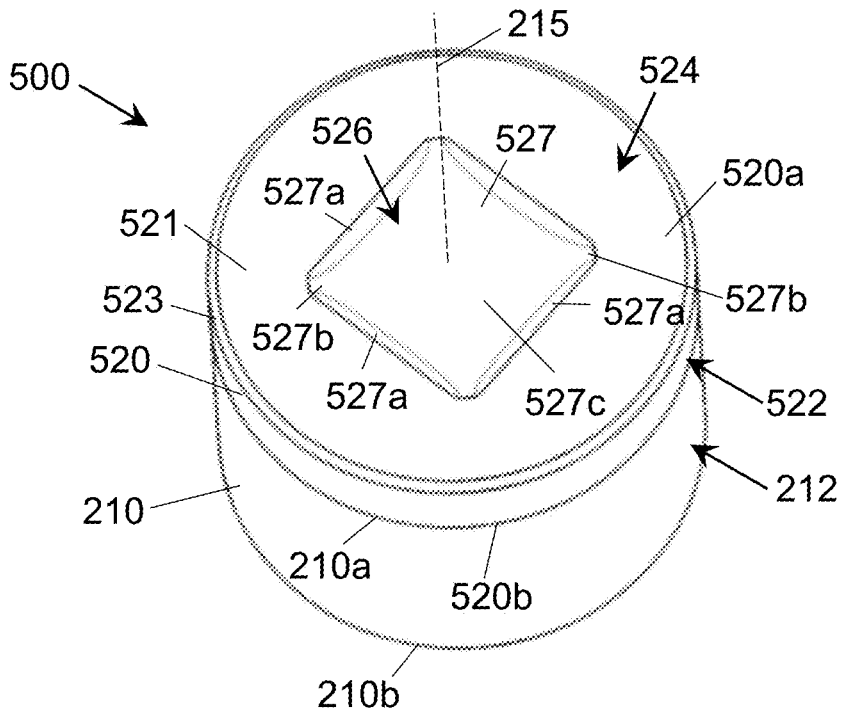
FIG. 17 is a perspective view of an embodiment of a cutter element for a fixed cutter drill bit in accordance with the principles described herein.
Figure 18:
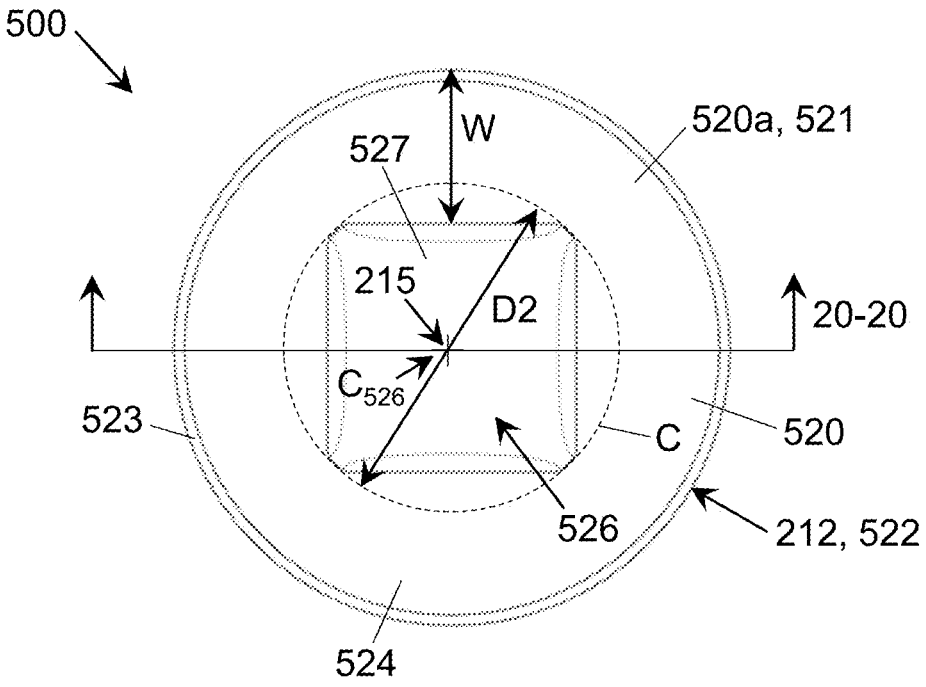
FIG. 18 is a top view of the cutter element of FIG. 17.
Figure 19:
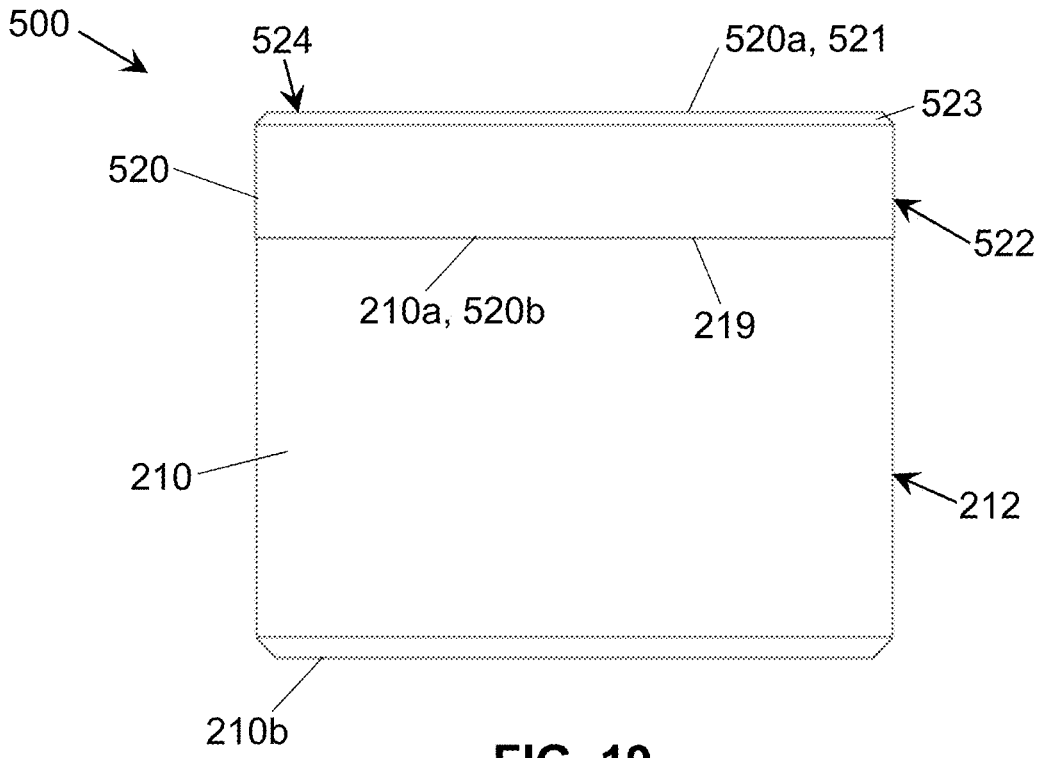
FIG. 19 is a side view of the cutter element of FIG. 17.

Referring still to FIGS. 17-20, in this embodiment, recess 526 is centered relative to central axis 215 in top view (i.e., recess 526 has a geometric center $C_{526}$ in top view that is intersected by axis 215). However, unlike recess 226 of cutter element 200 previously described, in this embodiment, recess 526 is not circular in top view as shown in FIG. 18 (i.e., recess 526 does not have a circular profile in top view). Rather, in this embodiment, recess 526 is generally rectangular, and more specifically square with rounded corners, in top view of FIG. 18 (i.e., recess 526 has a generally square outer profile in top view). As a result, the radial width W of planar surface 524 is not constant, but varies moving circumferentially about central axis 215. As shown in FIG. 18, recess 526 has a maximum outer dimension D2 defined by the diameter of the smallest reference circle C disposed about and enclosing recess 526 in top view.

Figure 20:
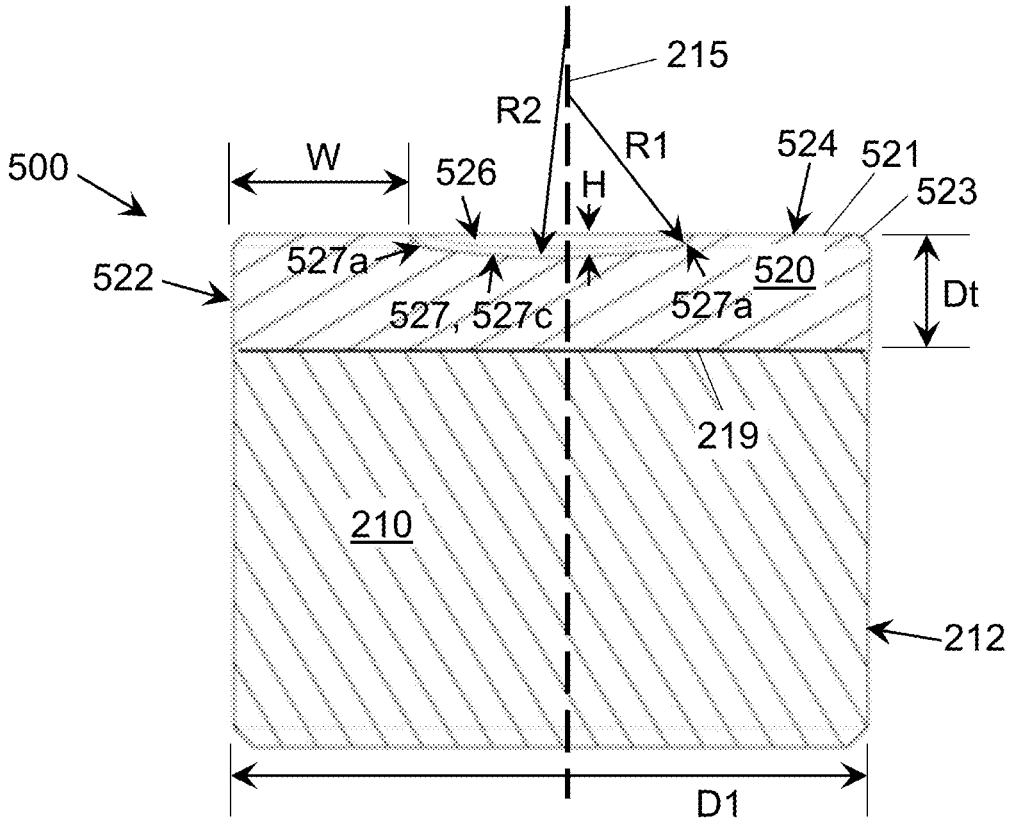
FIG. 20 is a cross-sectional view of the cutter element of FIG. 17 taken in section 20-20 of FIG. 18.

Referring now to FIG. 20, as previously described, recess 526 extends axially into planar surface 524. More specifically, recess 526 is defined by a smooth, continuously-contoured, concave (i.e., bowed inwardly) surface 527. Accordingly, recess 526 may also be described as being concave. Thus, it should be appreciated that recess 526 and concave surface 527 do not include any planar surface(s), and hence, may be described as being free of planar surface(s).

Concave surface 527, and hence recess 526, extends to a depth H measured axially from the plane containing planar surface 524. In this embodiment, concave surface 527 is disposed at and defined by two different radii of curvature R1, R2. In particular, concave surface 527 includes a plurality of circumferentially-spaced radially outer portions 527*a* extending from planar surface 524 along the straight sides of square recess 526, a plurality of circumferentially-spaced radially outer portions 527*b* extending from planar surface 524 along the curved corners or vertices of square recess 526, and a radially inner portion 527*c* extending radially inward from portions 527*a*, 527*b* to geometric center $C_{526}$ of square recess 526. As best shown in FIG. 17, outer portions 527*a*, 527*b* are circumferentially arranged in an alternating fashion about radially inner portion 527*c* along the outer perimeter of square recess 526. In other words, one outer portion 527*a* is disposed between and extends between each pair of circumferentially adjacent outer portions 527*b*. Each outer portion 527*a*, 527*b* of concave surface 527 is disposed at a constant or uniform radius of curvature R1, and inner portion 527*c* is disposed at a constant or uniform radius of curvature R2. In this embodiment, radius of curvature R1 is less than the radius of curvature R2. Although outer portions 527*a*, 527*b* are disposed at a different radius of curvature R1 as compared to inner portion 527*c* disposed at radius of curvature R2, each outer portion 527*a*, 527*b* smoothly transitions into inner portion 527*c* such that concave surface 527 is continuously-contoured. As recess 526 is centered relative to central axis 215 in this embodiment, each radius of curvature R1, R2 is measured from a point along central axis 215. Thus, the depth H generally increases moving radially inward from planar surface 524 along surface 527 to geometric center $C_{526}$ and central axis 215, and further, the depth H is maximum at the intersection of concave surface 527 and central axis 215 (i.e., at geometric center $C_{526}$). Thus, in this embodiment, the depth H is maximum at a single point along concave surface 527. Although recess 526 is centered relative to central axis 215 in this embodiment, in other embodiments, the recess (e.g., recess 526) may not be centered relative to the central axis of the substrate (e.g., central axis 215).

Cutter element 500 and cutting face 521 generally function in the same manner as cutter element 200 and cutting face 221, respectively, as previously described. Namely, cutter element 500 and cutting face 521 are generally designed and configured such that during drilling operations, planar surface 524, which is radially outside of concave recess 526, and bevel 523 directly engage and shear the formation, while drilling fluid enters and flows through concave recess 526, thereby minimizing and/or preventing contact between formation cuttings and concave surface 527 and offering the potential to improve cutting efficiency. Through substantial testing and analysis, it is believed that certain geometries and features of cutting face 521 offer particular benefits in improving the cutting efficiency. More specifically, planar surface 524 is preferably smoother than concave surface 527. In other words, the average surface roughness Ra of planar surface 524 is preferably less than the average surface roughness Ra of the concave surface 527. In general, the average surface roughness Ra of planar surface 524 preferably ranges from 0.02 micron to 1.20 micron, alternatively ranging from 0.05 micron to 0.80 micron, and alternatively ranging from 0.05 micron to 0.60 micron; and the average surface roughness Ra of concave surface 527 defining recess 526 preferably has an average surface roughness Ra ranging from 0.06 micron to 2.00 micron, alternatively ranging from 0.5 micron to 2.0 micron, and alternatively ranging from 0.80 micron to 1.60 micron. In addition, the ratio of the maximum depth H to the outer diameter D1 of cutter element 400 preferably ranges from 0.01 to 0.09, and alternatively ranges from 0.20 to 0.80; the ratio of each radius of curvature R1, R2 of concave surface 527 to the outer diameter D1 of cutter element 500 preferably ranges from 0.80 to 2.00, and alternatively ranges from 1.00 to 1.80; the ratio of the radial width W of planar surface 524 to the outer diameter D1 of the cutter element 500 preferably ranges from 0.05 to 0.50, and alternatively ranges from 0.06 to 0.40; the ratio of each radius of curvature R1, R2 of concave surface 427 to the radial width W of planar surface 424 preferably ranges from 5.00 to 9.00 and alternatively ranges from 5.50 to 8.50; and the ratio of the maximum depth H to the thickness Dt of cutting layer 520 preferably ranges from 0.05 to 0.36, and alternatively ranges from 0.06 to 0.30. Still further, for a cutter element 500 having an outer diameter D1 ranging from 11.00 mm to 25.00 mm, the maximum depth H preferably ranges from 0.20 mm to 1.60 mm, and alternatively ranges from 0.30 mm to 1.40 mm; each radius of curvature R1, R2 preferably ranges from 10.00 mm to 40.00 mm, and alternatively ranges from 12.00 mm to 36.00 mm; the radial width W of planar surface 424 preferably ranges from 1.50 mm to 5.00 mm, and alternatively ranges from 1.80 mm to 4.80 mm; and the maximum outer dimension D2 of concave recess 426 preferably ranges from 3.00 mm to 16.0 mm, and alternatively ranges from 3.3 mm to 14.6 mm. It should be appreciated that any one of the foregoing geometries, geometrical relationships, and features can be employed alone or in connection with any one or more of the other geometries, geometrical relationships, and features.

Figure 21:
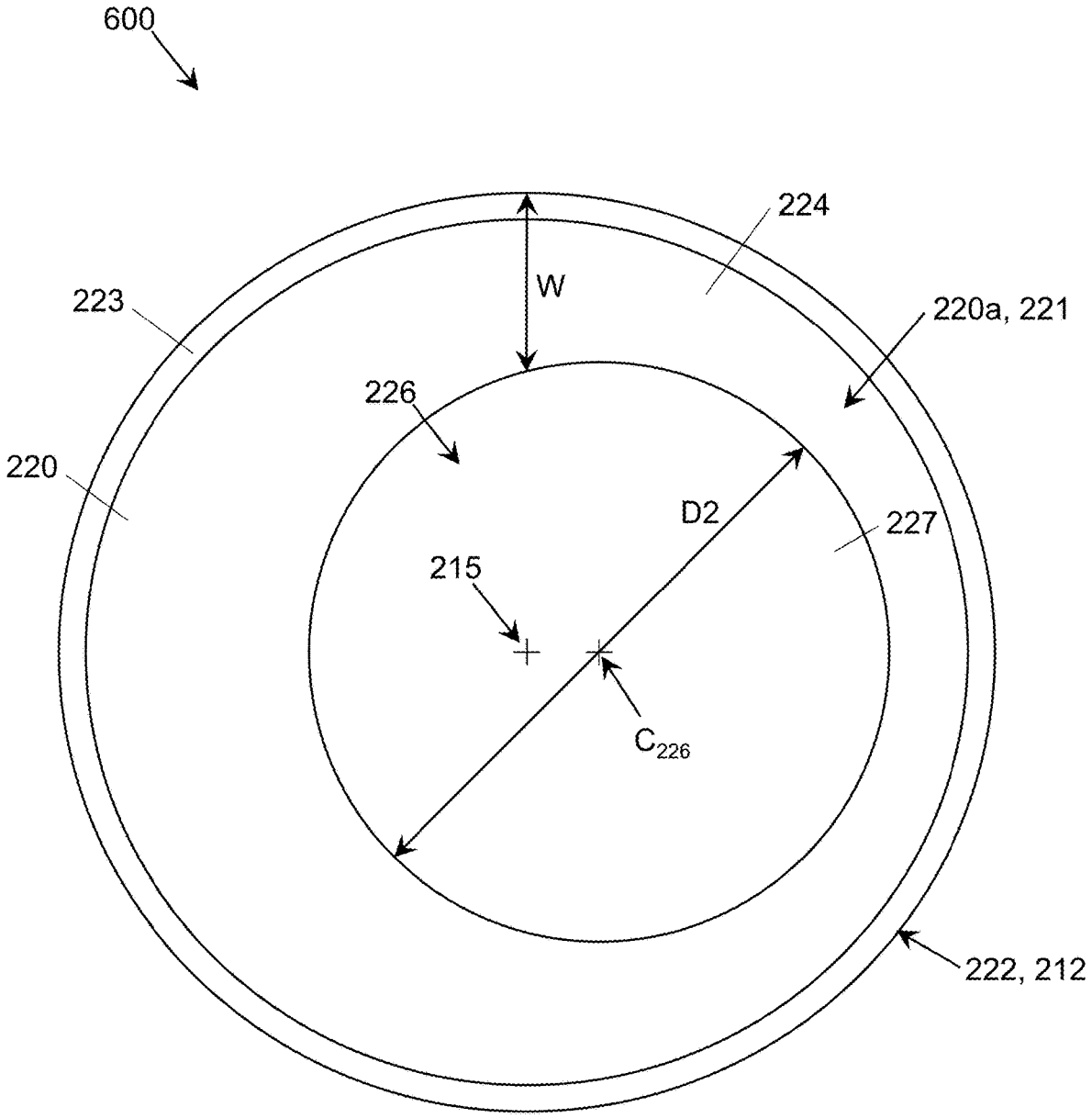
FIG. 21 is a top view of an embodiment of a cutter element in accordance with the principles described herein.

As previously noted, although concave recesses 226, 326, 426, 526 are centered along cutting face 221, 321, 421, 521, respectively, relative to central axis 215, in other embodiments, the concave recess (e.g., concave recess 226, 326, 426, 526) is not centered on the cutting face (e.g., cutting face 221, 321, 421, 521) relative to the corresponding central axis (e.g., central axis 215). For example, referring now to FIG. 21, a top view of an embodiment of a cutter element 600 that can be used in place of cutter element 200 in drill bit 100 is shown. Cutter element 600 is the same as cutter element 200 previously described with the sole exception that concave recess 226 is not centered relative to central axis 215. Rather, in this embodiment, geometric center $C_{226}$ of concave recess 226 is radially offset and spaced from central axis 215. Cutter element 600 generally functions in the same manner as cutter element 200 previously described.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cutter element for a fixed cutter drill bit configured to drill a borehole in a subterranean formation, the cutter element comprising:

a base portion having a central axis, a first end, a second end, and a radially outer surface extending axially from the first end to the second end; and a cutting layer fixably mounted to the first end of the base portion, wherein the cutting layer includes a cutting face distal the base portion and a radially outer surface extending axially from the cutting face to the radially outer surface of the base portion;

wherein the cutting face includes a planar surface disposed in a plane oriented perpendicular to the central axis and a concave recess extending axially into the planar surface, wherein the planar surface extends circumferentially about the concave recess;

wherein the planar surface has an average surface roughness Ra and the concave surface has an average surface roughness Ra, wherein the average surface roughness Ra of the planar surface is less than the average surface roughness Ra of the concave surface.

2. The cutter element of claim 1, wherein the concave recess is defined by a continuously contoured concave surface that is free of planar surfaces.

3. The cutter element of claim 1, wherein the average surface roughness Ra of the planar surface ranges from 0.05 micron to 0.60 micron and the average surface roughness Ra of the concave surface ranges from 0.06 micron to 2.00 micron.

4. The cutter element of claim 1, wherein the concave recess has a geometric center that is intersected by the central axis of the base portion.

5. The cutter element of claim 4, wherein the concave recess is circular in a top view of the cutter element, wherein the concave recess has a diameter D2 in the top view, and wherein the diameter D2 ranges from 3.0 mm to 16.0 mm.

6. The cutter element of claim 4, wherein the concave recess is non-circular in a top view of the cutter element.

7. The cutter element of claim 6, wherein the concave recess has a maximum outer dimension D2 defined by a diameter of a smallest reference circle that encloses the concave recess in the top view, wherein the maximum outer dimension D2 ranges from 3.0 mm to 16.0 mm.

8. The cutter element of claim 1, wherein the concave surface includes a radially inner portion disposed at a radius of curvature R that ranges from 10.0 mm to 40.0 mm.

9. The cutter element of claim 8, wherein a ratio of the radius of curvature R of the radially inner portion of the concave surface to an outer diameter D1 of the base portion ranges from 0.80 to 2.00.

10. The cutter element of claim 8, wherein the planar surface has a radial width W measured radially from the concave recess to the radially outer surface of the cutting layer, wherein the radial width W ranges from 1.50 mm to 5.00 mm, wherein a ratio of the radius of curvature R of the radially inner portion of the concave surface to the radial width W of the planar surface ranges from 5.0 to 9.0.

11. The cutter element of claim 1, wherein the concave surface includes a radially outer portion disposed at a radius of curvature R1 and a radially inner portion disposed at a radius of curvature R2 that is different from the radius of curvature R1, wherein each radius of curvature R1, R2 ranges from 10.0 mm to 40.0 mm.

12. The cutter element of claim 11, wherein a ratio of each radius of curvature R1, R2 of the concave surface to an outer diameter D1 of the base portion ranges from 0.80 to 2.00.

13. The cutter element of claim 1, wherein the planar surface has a radial width W measured radially from the concave recess to the radially outer surface of the cutting layer, wherein the radial width W ranges from 1.50 mm to 5.00 mm.

14. The cutter element of claim 13, wherein a ratio of the radial width W of the planar surface to an outer diameter D1 of the base portion ranges from 0.05 to 0.50.

15. The cutter element of claim 1, wherein the concave surface extends to a maximum depth H measured axially from the planar surface, wherein the maximum depth H ranges from 0.20 mm to 1.60 mm, and wherein a ratio of the maximum depth H to an outer diameter D1 of the base portion ranges from 0.01 to 0.09.

16. The cutter element of claim 15, wherein the maximum depth H is located at a single point along the concave surface.

17. The cutter element of claim 15, wherein the cutting layer has a thickness Dt measured axially from the planar surface to the base portion, wherein a ratio of the maximum depth H to the depth Dt of the cutting layer ranges from 0.05 to 0.36.

18. A cutter element for a fixed cutter drill bit configured to drill a borehole in a subterranean formation, the cutter element comprising:

a base portion having a central axis, a first end, a second end, and a radially outer surface extending axially from the first end to the second end; and a cutting layer fixably mounted to the first end of the base portion, wherein the cutting layer includes a cutting face distal the base portion and a radially outer surface extending axially from the cutting face to the radially outer surface of the base portion;

wherein the cutting face includes a planar surface disposed in a plane oriented perpendicular to the central axis and a concave recess extending axially into the planar surface, wherein the planar surface extends circumferentially about the concave recess, wherein the concave recess is defined by a continuously contoured concave surface that is free of planar surfaces;

wherein the concave recess has a geometric center in a top view of the cutter element that is intersected by the central axis;

wherein the concave recess is circular in the top view of the cutter element;

wherein the concave surface is disposed at a uniform radius of curvature R.

19. The cutter element of claim 18, wherein the concave recess has a diameter D2 in the top view, and wherein the diameter D2 ranges from 3.0 mm to 16.0 mm;

wherein the radius of curvature R of the concave recess ranges from 10.0 mm to 40.0 mm.

20. The cutter element of claim 18, wherein a ratio of the radius of curvature R of the concave surface to an outer diameter D1 of the base portion ranges from 0.80 to 2.00.

21. The cutter element of claim 18, wherein the planar surface is an annular surface having a radial width W measured radially from the concave recess to the radially outer surface of the cutting layer, wherein a ratio of the radial width W of the planar surface to an outer diameter D1 of the base portion ranges from 0.05 to 0.50.

22. The cutter element of claim 21, wherein a ratio of the radius of curvature R of the concave surface to the radial width W of the planar surface ranges from 5.0 to 9.0.

23. The cutter element of claim 18, wherein the concave surface extends to a maximum depth H measured axially from the planar surface, wherein a ratio of the maximum depth H to an outer diameter D1 of the base portion ranges from 0.01 to 0.09.

24. The cutter element of claim 23, wherein the cutting layer has a thickness Dt measured axially from the planar surface to the base portion, wherein a ratio of the maximum depth H to the depth Dt of the cutting layer ranges from 0.05 to 0.36.

25. The cutter element of claim 18, wherein the planar surface has an average surface roughness Ra and the concave surface has an average surface roughness Ra, wherein the average surface roughness Ra of the planar surface is less than the average surface roughness Ra of the concave surface.

* * * * *